US010995708B2

(12) United States Patent
Maritan et al.

(10) Patent No.: US 10,995,708 B2
(45) Date of Patent: May 4, 2021

(54) INTERNAL COMBUSTION ENGINE WITH AN IMPROVED INTAKE SYSTEM AND MOTORVEHICLE THEREOF

(71) Applicant: PIAGGIO & C. S.P.A., Pisa (IT)

(72) Inventors: Mattia Maritan, Pisa (IT); Carlo Carapellucci, Pisa (IT)

(73) Assignee: PIAGGIO & C. S.P.A., Pisa (IT)

( * ) Notice: Subject to any disclaimer, the term of this patent is extended or adjusted under 35 U.S.C. 154(b) by 227 days.

(21) Appl. No.: 16/346,689

(22) PCT Filed: Nov. 3, 2017

(86) PCT No.: PCT/IB2017/056882

§ 371 (c)(1),
(2) Date: May 1, 2019

(87) PCT Pub. No.: WO2018/083651

PCT Pub. Date: May 11, 2018

(65) Prior Publication Data

US 2019/0316550 A1 Oct. 17, 2019

(30) Foreign Application Priority Data

Nov. 4, 2016 (IT) ..... 102016000111203
Nov. 4, 2016 (IT) ..... 102016000111255
(Continued)

(51) Int. Cl.
*F02M 35/10* (2006.01)
*F02M 35/04* (2006.01)
*F02M 35/16* (2006.01)

(52) U.S. Cl.
CPC .... *F02M 35/10039* (2013.01); *F02M 35/044* (2013.01); *F02M 35/162* (2013.01)

(58) Field of Classification Search
CPC ..... F02M 35/10039; F02M 35/044; F02M 35/162; Y02T 10/12
See application file for complete search history.

(56) References Cited

U.S. PATENT DOCUMENTS 2,983,592 A * 5/1961 Jones ..... F02M 21/047 48/184
5,005,533 A * 4/1991 Suzuki ..... F02M 35/10 123/184.22
(Continued)

FOREIGN PATENT DOCUMENTS

EP 1283350 A2 2/2003
EP 1580422 A1 9/2005
(Continued)

*Primary Examiner* — Joseph J Dallo
*Assistant Examiner* — Kurt Philip Liethen
(74) *Attorney, Agent, or Firm* — Cantor Colburn LLP

(57) ABSTRACT

Internal combustion engine comprising—a first pair of cylinders which accommodate, according to a rectilinear reciprocating motion, relative first pistons operatively associated to a motor shaft rotating around a motor axis disposed in a transverse direction, perpendicular to a longitudinal running direction of an associable vehicle, —a suction system comprising a filter box which delimits a suction volume which houses at least a first front suction duct and at least a first rear suction duct, respectively disposed in an advanced and retracted position in relation to an air/suction mixture inlet direction, each suction duct channelling the air/suction mixture before entering in the respective cylinders, —wherein said first front and rear suction ducts are fixed and have respective mutually different lengths.

20 Claims, 26 Drawing Sheets

(30) Foreign Application Priority Data

Nov. 4, 2016 (IT) ..... 102016000111263
Nov. 4, 2016 (IT) ..... 102016000111270

(56) References Cited

U.S. PATENT DOCUMENTS

| | | | | |
|---|---|---|---|---|
| 5,653,201 | A | 8/1997 | Hosoya | |
| 5,918,576 | A | 7/1999 | Ohoka | |
| 6,202,626 | B1 * | 3/2001 | Ito | F02M 35/10039 123/336 |
| 10,774,797 | B2 * | 9/2020 | Miki | B01D 46/0045 |
| 2006/0042603 | A1 | 3/2006 | Fukami | |
| 2009/0018783 | A1 * | 1/2009 | Panciroli | F02D 41/18 702/47 |
| 2011/0155086 | A1 | 6/2011 | Matsuda | |
| 2014/0123919 | A1 * | 5/2014 | Shibata | F01N 3/32 123/41.56 |

FOREIGN PATENT DOCUMENTS

| | | | |
|---|---|---|---|
| EP | 1655464 | A2 | 5/2006 |
| EP | 2617982 | A1 | 7/2013 |

* cited by examiner

INTERNAL COMBUSTION ENGINE WITH AN IMPROVED INTAKE SYSTEM AND MOTORVEHICLE THEREOF

FIELD OF APPLICATION

The present invention relates to an internal combustion engine with improved suction system and a relative motor vehicle.

PRIOR ART

As it is known, in the sector of internal combustion engines the need is felt to provide an engine that has high energy efficiency. Energy efficiency depends, among other factors, also on the coefficient of filling of the engine, i.e. the ability to introduce the largest possible amount of air/mixture into the cylinder.

To this end, a variety of technical solutions have been developed in the prior art.

For example, it is known to provide the engine supercharging: such a solution, whether it be with a positive displacement compressor or turbocharger, however, is costly and complex to be developed. It also requires appropriate volumes/dimensions that often are not employable in the motorcycle sector.

The absence of engine supercharging requires, in order to improve the engine filling factor, a thorough knowledge of fluid dynamics of the internal combustion engine.

In particular, in high-performance engines in order to obtain a better volumetric efficiency, a geometry is conferred to the suction systems such as to allow the optimal exploitation of the inertia of the gases and of the pulsator phenomena (pressure waves travelling with sonic speed) that take place within the gaseous mass. The gases have mass and therefore follow the laws of inertia; once in motion, they are therefore reluctant to stop suddenly and on the contrary if at rest, they are reluctant to start moving. When the piston, once reached the bottom dead centre of the end of the suction stroke, reverses its motion and begins to rise towards the upper dead centre, the air-fuel mixture coming from the duct does not stop suddenly, but due to the inertia continues to enter the cylinder. In order to exploit this phenomenon to improve the filling of the cylinder (i.e. the volumetric efficiency), the intake valve is made to close with a considerable delay with respect to the BDC. This delay must of course be greater the higher is the revolution speed at which one wants to obtain the maximum torque. Ideally, the gas column which from the duct flows into the cylinder should stop exactly when the valve finishes closing. For each given distribution timing (i.e. for any given closing delay) this can only happen at a given rotation speed. At higher speeds, the valve closes when the gases have not sopped yet (and therefore would tend to enter again into the cylinder), whereas at lower speeds it closes when the gases do not only have already stopped but have even reversed their motion (and thus a part of the fresh gas which had already entered comes out from the cylinder). Each length of suction ducts corresponds to a speed according to which the exploitation of gas inertia is optimum. Working on the geometry of the suction ducts it is also possible to conveniently take advantage of the pulsator phenomena: ideally, just when the valve is about to close, a wave of positive pressure should arrive, capable, as an authentic "piston fluid", of pushing a certain amount of gas in the cylinder that otherwise would not enter.

More in detail, the depression wave generated by the piston in the suction duct propagates up to its open end and is reflected transformed into an overpressure wave that returns towards the cylinder.

Once arrived at the valve, it pushes the air thus compressed into the cylinder, generating the desired dynamic supercharging. By closing the valve at the instant in which the maximum amount of air has entered into the cylinder, the maximum volumetric efficiency is achieved.

The reflection wave generated by the expulsion of the gases in the exhaust line propagates up to its open end, transforming into a depression wave, which returns towards the cylinder. If, at the instant in which it arrives there, the exhaust and suction valves are in the crossing phase, that is, semi-open simultaneously, the depression sucks from the suction duct through the combustion chamber and carries out the following three functions: the re-suction of the flue gas possibly entered the suction duct during the crossing phase, the washing of the combustion chamber and a dynamic pre-suction of air even before the actual intake stroke of the plunger begins.

The two phenomena of fundamental importance therefore are:

1) an intense dynamic overpressure, generated by the suction duct, which originates a supercharging effect, 2) an intense dynamic depression, generated by the exhaust system (pipe(s)+tube(s)), which carries out the re-suction of the flue gases possibly entered the suction duct during the crossing, the washing of the combustion chamber and the dynamic pre-start of the suction phase.

In order to exploit such fluid dynamic phenomena to improve the efficiency of the engine it is therefore known to use suction devices with variable length: in other words, suction trumpets are provided, having variable length as a function of the engine rotation speed. In this way, an attempt is made to 'tune' the motor rotation speed with the length of the intake ducts so as to exploit the onset of 'resonance' phenomena (described above) which may increase the suctioned air/mixture flow rate and therefore, the volumetric filling of a wide range of rotation speeds.

However, this solution is also not free from drawbacks. For example, motor means are required to drive the movable parts of the variable-length suction ducts; such motors means cause an increase of costs, weight and size; such dimensions, moreover, reduce the useful suction volume (air-box).

In addition, the movable parts, and the relative drives, inevitably change the overall suction fluid dynamics, worsening it, since they constitute an obstacle to the suctioned air/mixture flow passage.

In addition, it is necessary to employ a control unit which manages in an extremely fast and precise manner (think of the extreme variability of the rotation speed of a motorcycle engine) the movement of the variable-length suction ducts.

Therefore, the known solutions of variable-length ducts have drawbacks in terms of cost, overall dimensions, weights and tuning.

DISCLOSURE OF THE INVENTION

The need of solving the drawbacks and limitations mentioned with reference to the prior art is therefore felt.

Such a need is met by an internal combustion engine according to claim 1.

DESCRIPTION OF THE DRAWINGS

Further features and advantages of the present invention will appear more clearly from the following description of preferred non-limiting embodiments thereof, in which.

Elements or parts of elements in common o the embodiments described below are referred to with the same reference numerals.

DETAILED DESCRIPTION

Figure 1:
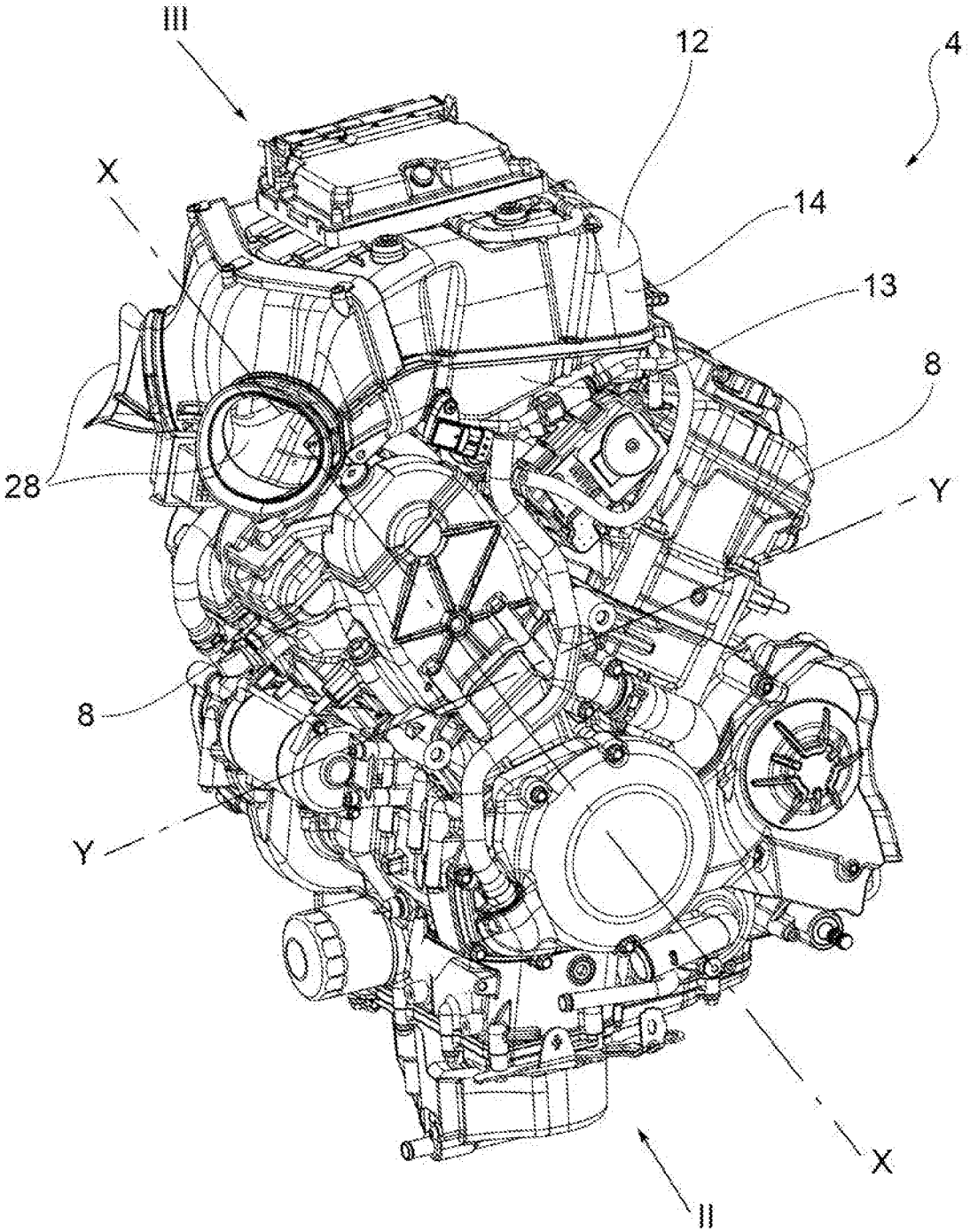
FIG. 1 shows a perspective view of an internal combustion engine according to the present invention.
Figure 2:
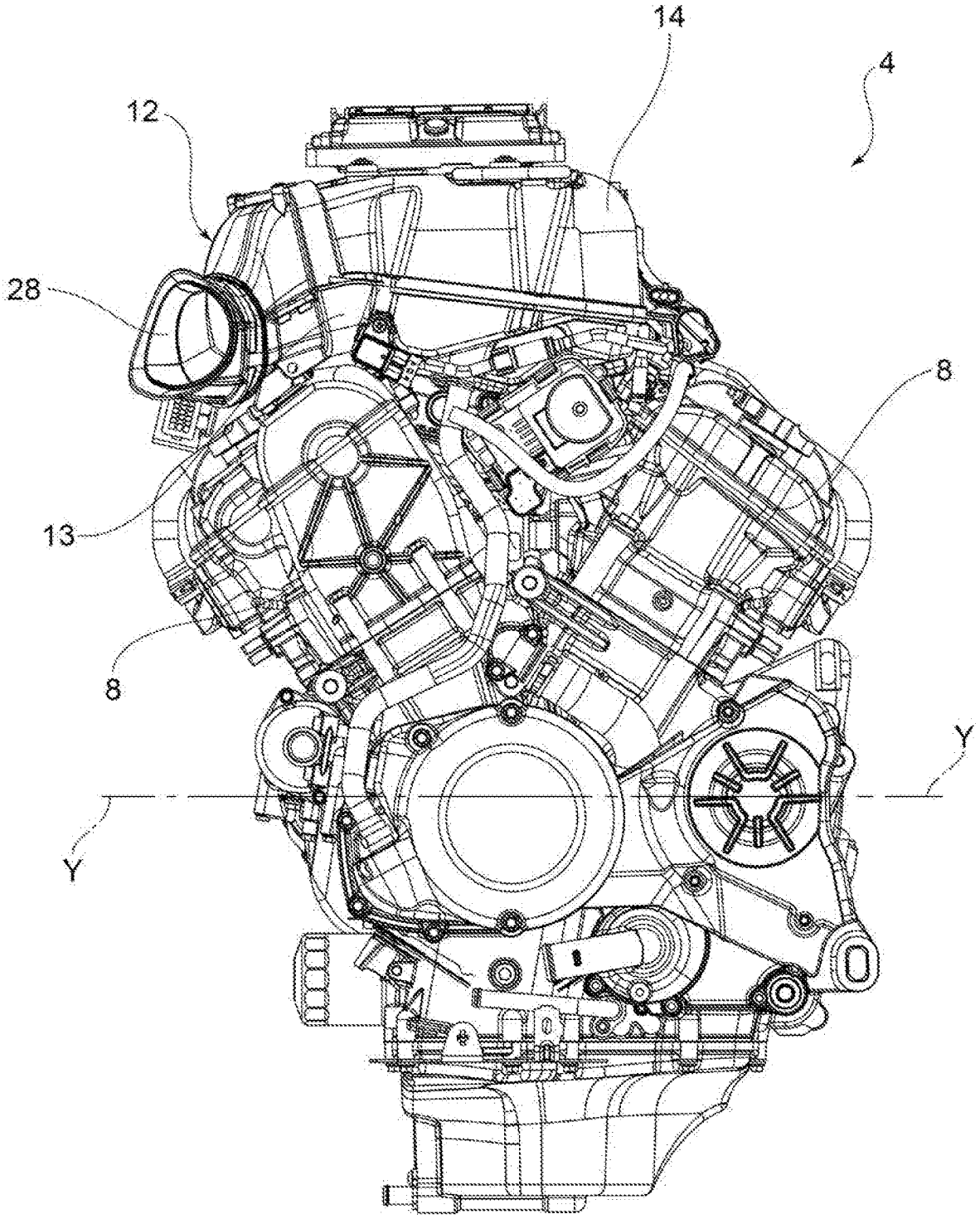
FIG. 2 shows a lateral view of the internal combustion engine in FIG. 1 from the side of arrow II in FIG. 1.

With reference to the above figures, reference numeral 4 indicates as a whole an internal combustion engine comprising a first pair of cylinders 8 which accommodate, according to a rectilinear reciprocating motion, relative first pistons operatively associated to a motor shaft rotating around a motor axis X-X. According to an embodiment, said motor axis X-X- is disposed in a transverse direction, perpendicular to a longitudinal running direction Y-Y of an associable vehicle.

The type of architecture of the internal combustion engine is not binding for the purposes of the present invention; however, the present invention allows optimizing the fluid dynamic suction behaviour of any internal combustion engine architecture, although the accompanying figures show exclusively 'V' architectures of multi-cylinder engines. In fact, the present invention also applies to single-cylinder engines, as well as in-line multi-cylinder engines.

In the following description, the superscript '1' shall be used to indicate components of the engine relative to the first pair of cylinders 8.

Figure 7:
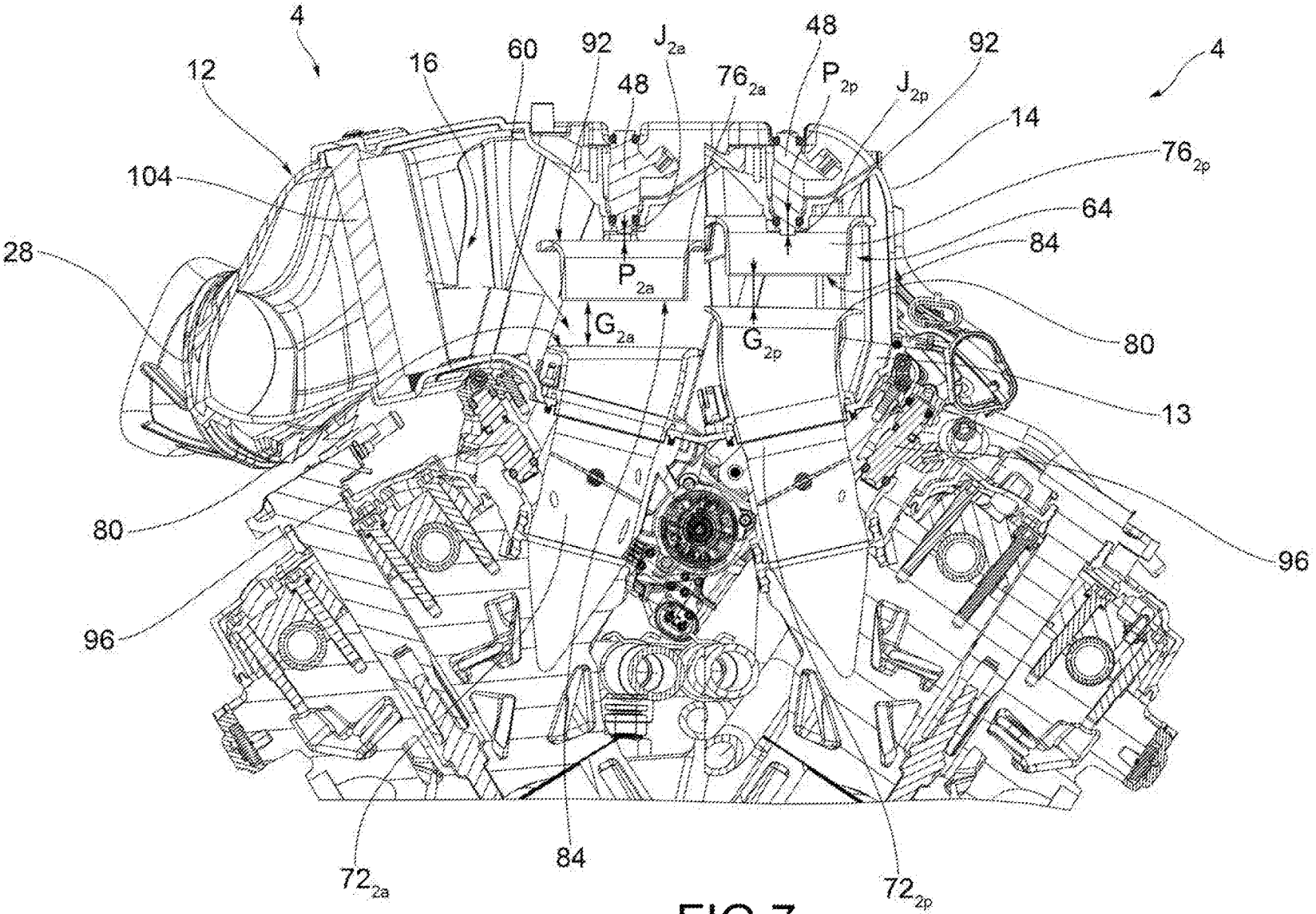
FIG. 7 shows a partially sectional view of a filter box and a part of the head of an internal combustion engine according to the present invention.

As better shown in FIG. 7, engine 4 comprises a suction system comprising a filter box 12 which delimits a suction volume 16. The filter box 12 houses an air filter 104; preferably, the filter box 12 comprises a bottom cover 13 and a top cover 14 removably associated with each other.

Figure 8:
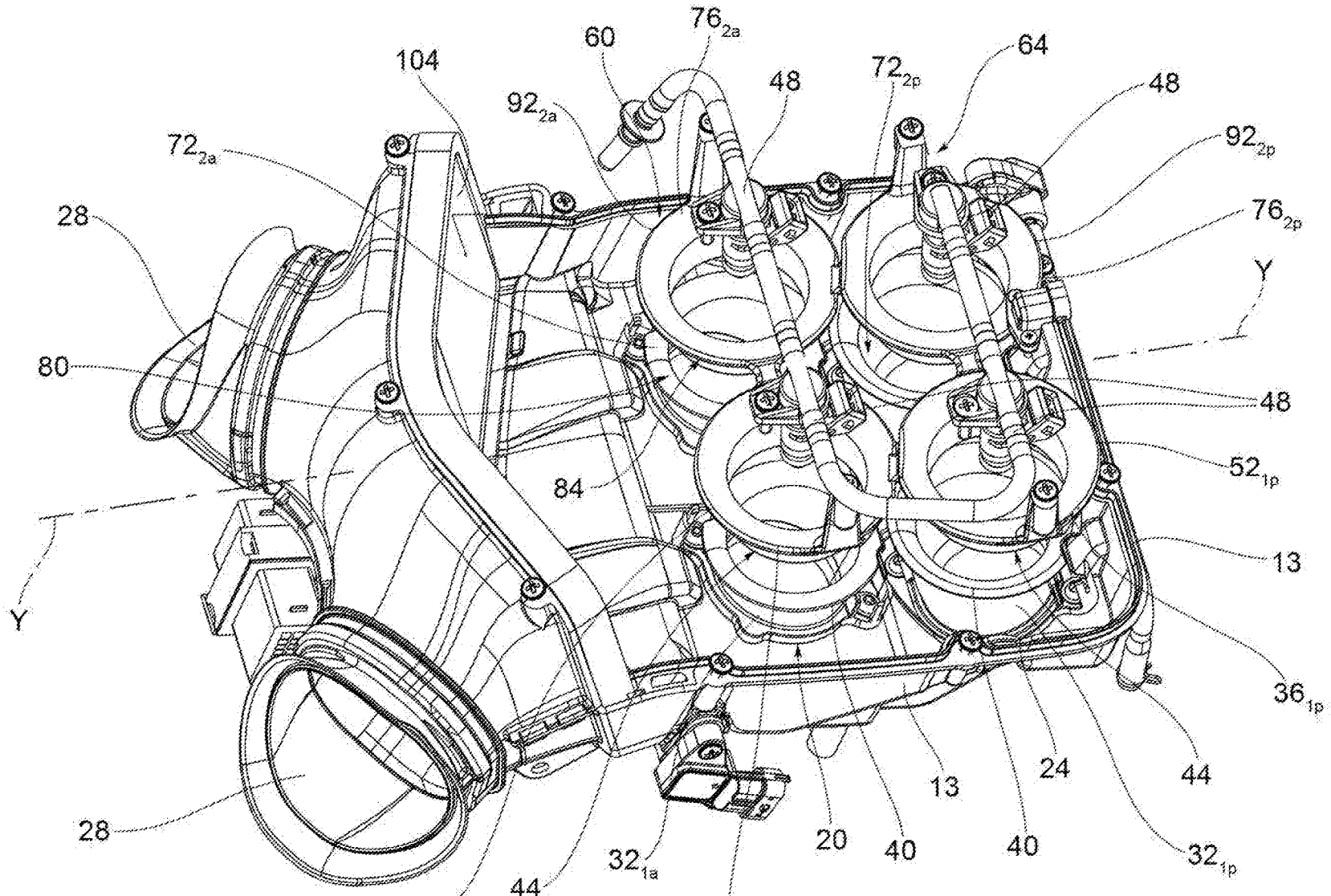
FIG. 8 shows a partial perspective view of a filter box group according to an embodiment of the present invention.
Figure 9:
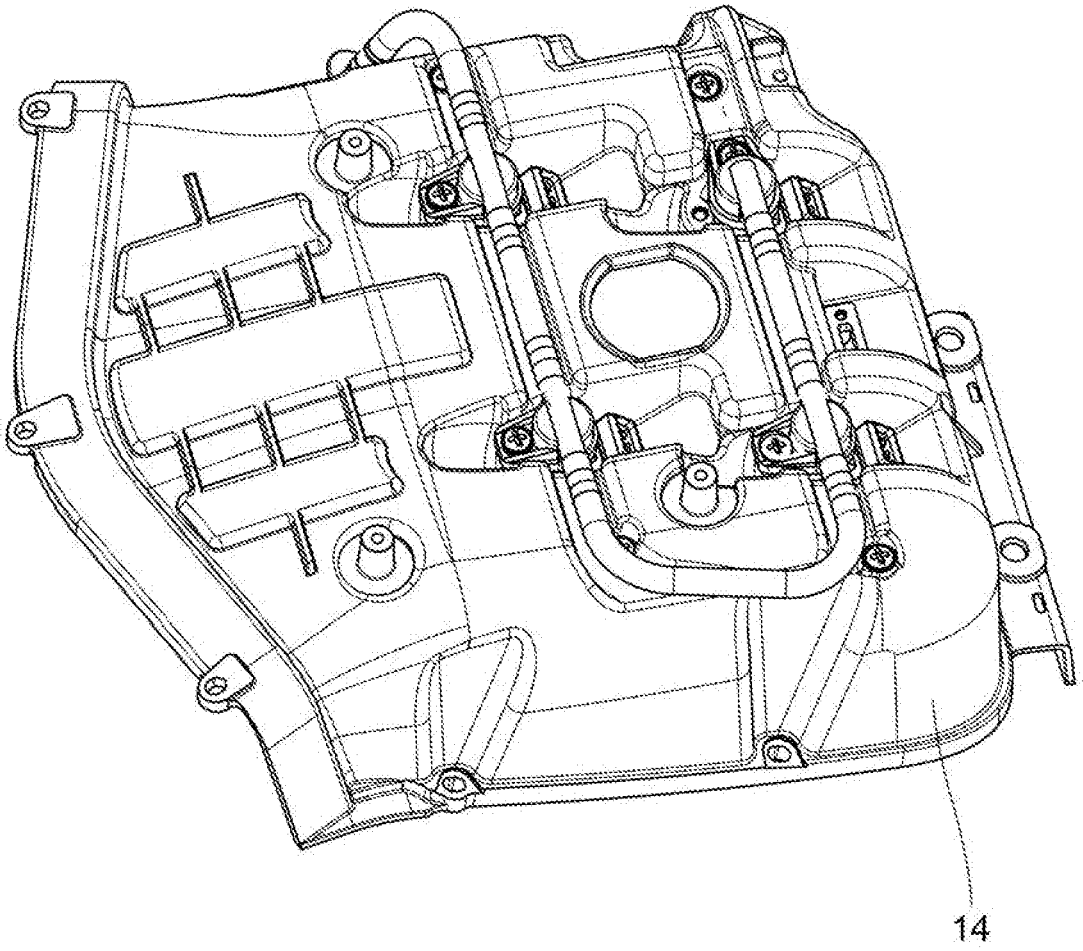
FIGS. 9-10 show perspective views, from different angles, of an upper cover of a filter box for internal combustion engine according to an embodiment of the present invention.
Figure 10:
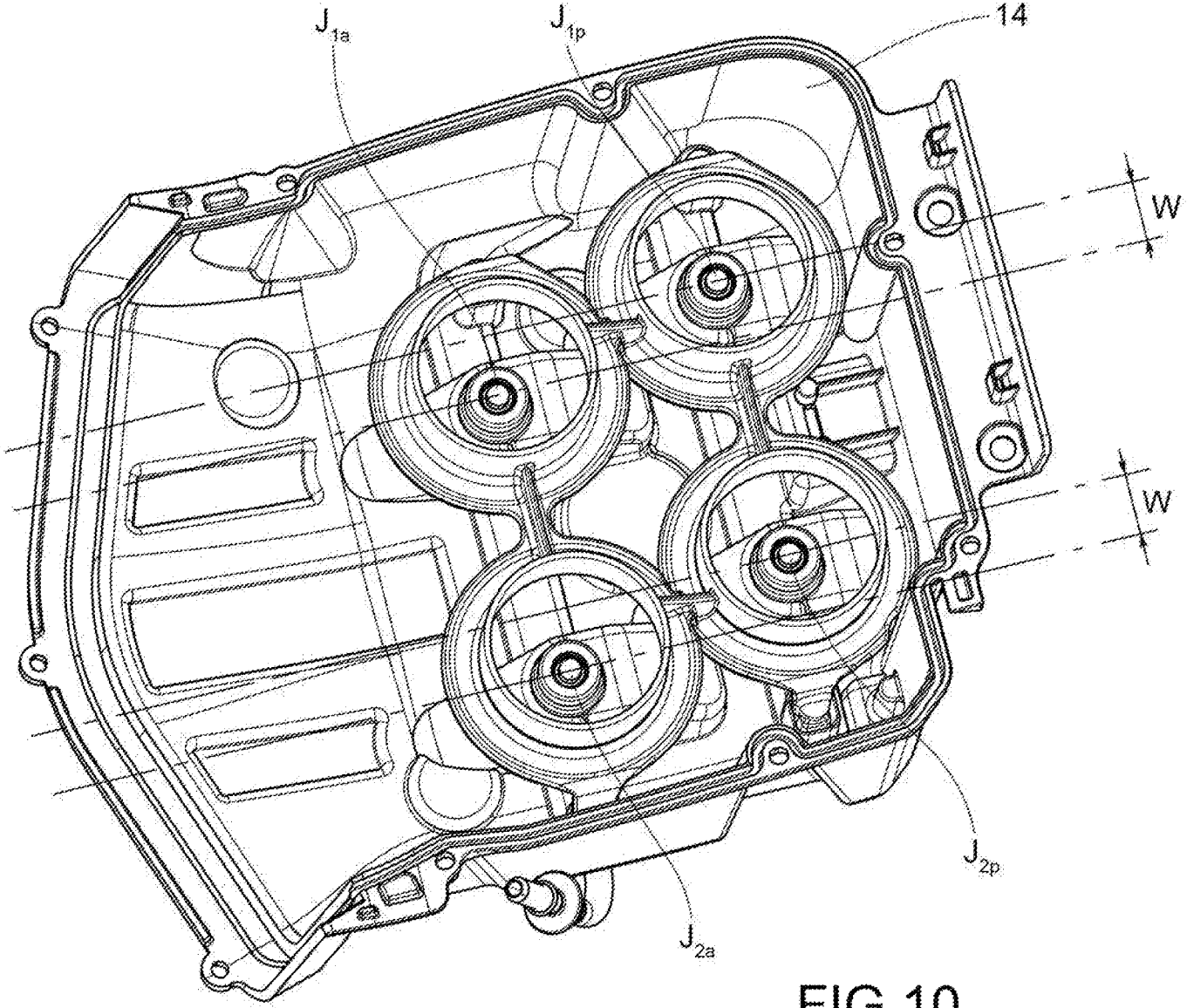
Figure 11:
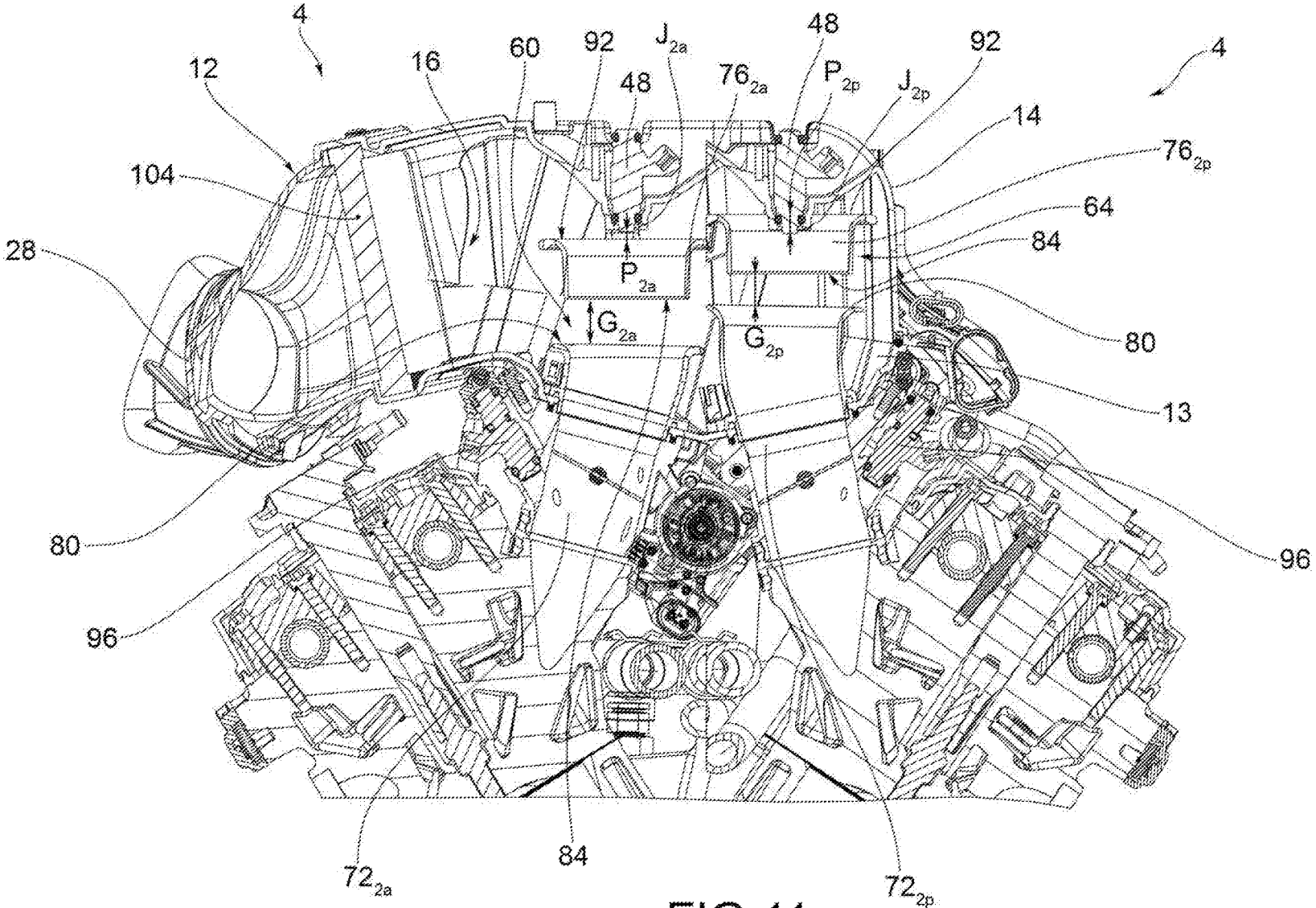
FIG. 11 shows a partially sectional view of a filter box and a part of the head of an internal combustion engine according to an embodiment of the present invention.

The suction volume 16 houses at least a first front suction duct 20 and at least a first rear suction duct 24, respectively disposed in an advanced and retracted position in relation to a suction air/mixture inlet direction (FIG. 8).

In the following description, the superscript 'a' shall be used to indicate components of the engine relative to the front suction duct 20, and the superscript 'p' shall be used to indicate engine components relative to the rear suction duct 24.

For example, said suction air/mixture enters the suction volume 16 via one or more inlet mouths 28 preferably arranged in frontal position with respect to the direction of travel of the vehicle (FIG. 8).

Each suction duct 20, 24 channels the suction air/mixture before entering in the respective cylinders.

For the purposes of the present invention, the angle identified by the first pair of cylinders 8, which are generally arranged as a 'V', i.e. are not aligned and parallel to each other with respect to a direction parallel to the engine axis X-X, is irrelevant.

Advantageously, the first front and rear suction ducts 20, 24 are fixed; according to one embodiment, said first front and rear suction ducts 20, 24 have mutually different respective lengths.

By 'fixed' it is meant that said front and rear suction ducts 20, 24 are integral with the filter box 12.

Each first front and rear suction duct 20, 24 is divided into two first fixed trumpets completely separated and aligned with each other, comprising a first lower trumpet 32 and a first upper trumpet 36.

The alignment between the fixed suction trumpets must be understood with respect to a vertical, i.e. overlapping direction, so that the overlapping trumpets completely separated from each other can altogether define a complete suction duct, continuous with the exception of the separation gap between the trumpets themselves, as described below.

The first upper trumpet 36 is facing an upper injector device, as better described below, while the first lower trumpet 32 is facing the corresponding cylinder and is fixed to a lower cover of the filter box 12.

Figure 5:
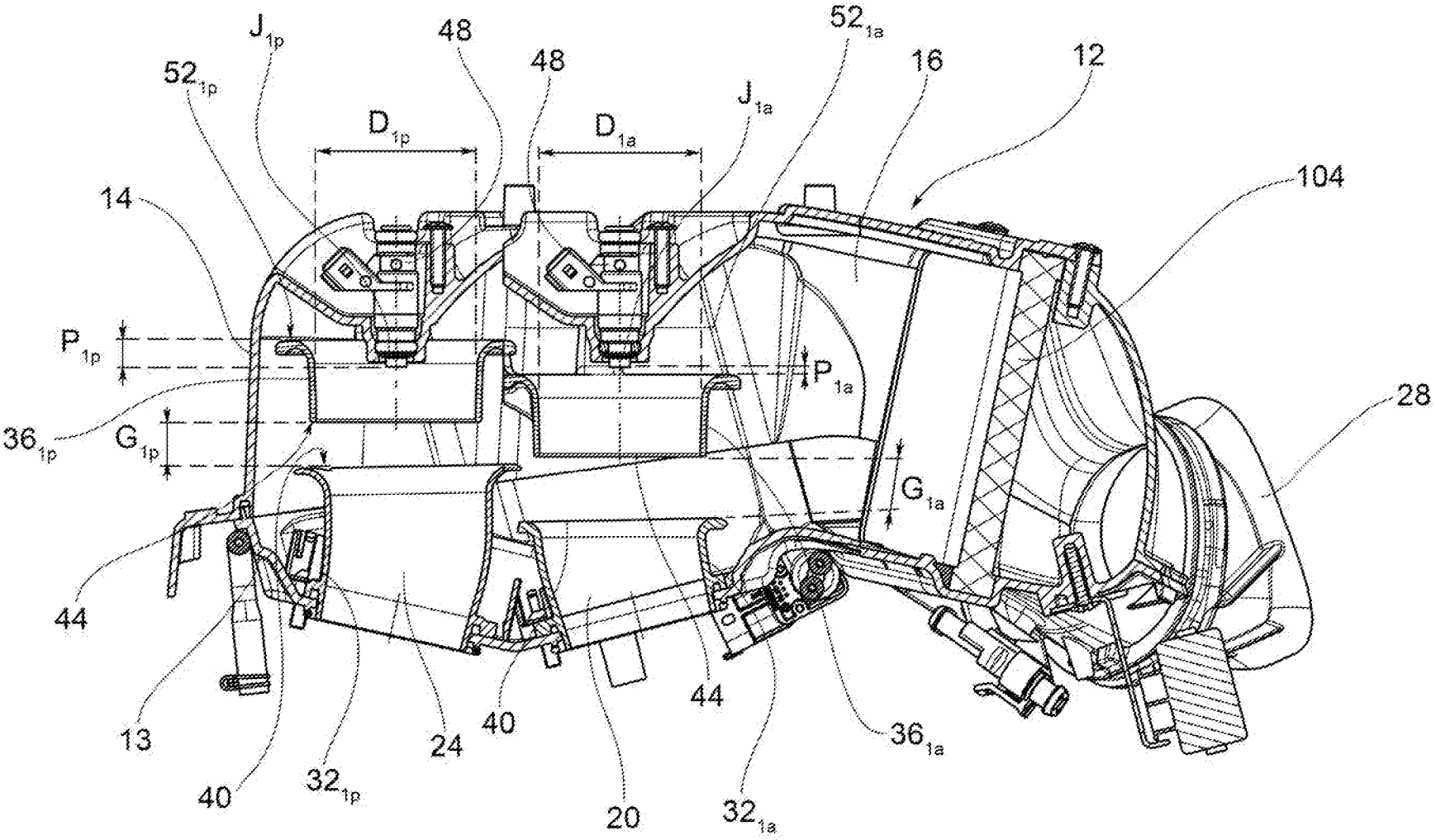
FIG. 5 shows a sectional view of the filter box group of the engine in FIG. 1, along the section line V-V indicated in FIG. 4.
Figure 6:
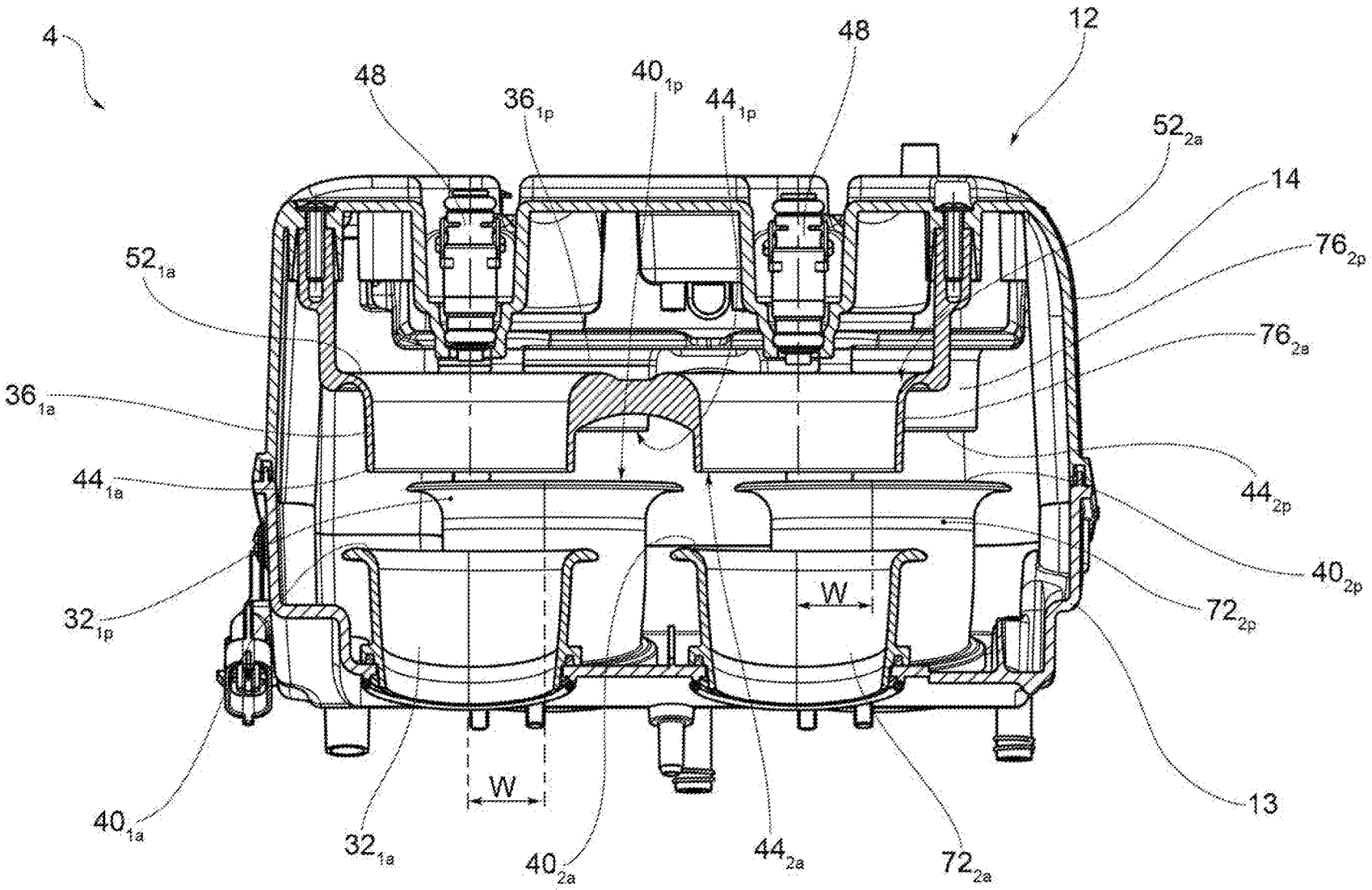
FIG. 6 shows a sectional view of the filter box group of the engine in FIG. 1, along the section line V-V indicated in FIG. 4.

As shown in FIG. 5, the first upper and lower trumpets 36, 32 are completely separated from each other, defining a gap G1 between a lower leading edge 40 of the first lower trumpet 32 and an upper trailing edge 44 of the first upper trumpet 36.

Gap G1 constitutes a passage section for the suction air/mixture to be channelled within the first cylinders 8.

Advantageously, gap G1*a* of the first front suction duct 20 is different from gap G1P of the first rear suction duct 24. The difference between gap G1*a* of the first front suction duct 20 and gap G1P of the first rear suction duct 24 can be established as a function of the inclination and position of the corresponding cylinder. This difference can also be established as a function of other geometric and technological parameters of the engine.

The difference between the above-mentioned gaps is expressed as the difference of the distance between the edges of the respective front 20 and rear 24 suction ducts.

Such a difference may be provided between all the suction ducts (front and rear) or only between some of them (front or rear).

According to one embodiment, gap G1*a* of the first front suction duct 20 is comprised between 15% and 35% of an inner diameter D1*a* of the first upper trumpet 36 of the first front suction duct 20.

According to one embodiment, gap G1*p* of the first rear suction duct 24 is comprised between 10% and 30% of an inner diameter D1*p* of the first upper trumpet 36 of the first rear suction duct 24.

As mentioned above, the internal combustion engine 4 comprises at least one upper fuel injector device 48 oriented so as to inject fuel into each first front and rear suction duct 20, 24, in which an injection point J of each upper fuel injector device 48 is a step P away from an upper leading edge 52 of a corresponding first upper trumpet 36, wherein step P1*a* of the first front suction duct 20 is different from step P1*p* of the first rear suction duct 24.

Preferably, step P1*a* of the first front suction duct 20 is comprised between 3% and 7% of an inner diameter D1*a* of the first upper trumpet 36 of the first front suction duct 20.

According to one embodiment, the injection point J1*a* of the first front suction duct 20 is external with respect to the first upper trumpet 36 of the first front suction duct 20.

In this way, at least partially, the fuel jet injected from the injection point is subjected to the direct action of the suction air flow that impinges it in a plane parallel to the upper leading edge 52 before the jet enters the first upper trumpet 36.

In general, the purpose of each upper trumpet 36, 76 is to convey the flow of fuel, atomized by the respective upper injector device 48, into the corresponding lower trumpet 32, 72.

Therefore, according to possible embodiments of the present invention, each upper fuel injector device 48 may be integrally contained in the corresponding upper trumpet, or partially contained or even completely external with respect to the trumpet itself.

According to one embodiment, step P1*p* of the first rear suction duct 24 is comprised between 10% and 20% of an inner diameter D1*p* of the first upper trumpet 36 of the first rear suction duct 24.

According to one embodiment, the injection point J1*p* of the first rear suction duct 24 is internal with respect to the first upper trumpet 36 of the first rear suction duct 24.

In this way, the fuel jet injected from the injection point is not subjected to the direct action of the suction air flow before it jet enters the first upper trumpet 36.

According to one embodiment, said first cylinders 8 are partially offset from each other along the transverse direction, by an offset W, so as to have a partial misalignment between them with respect to the suction air/mixture.

Figure 4:
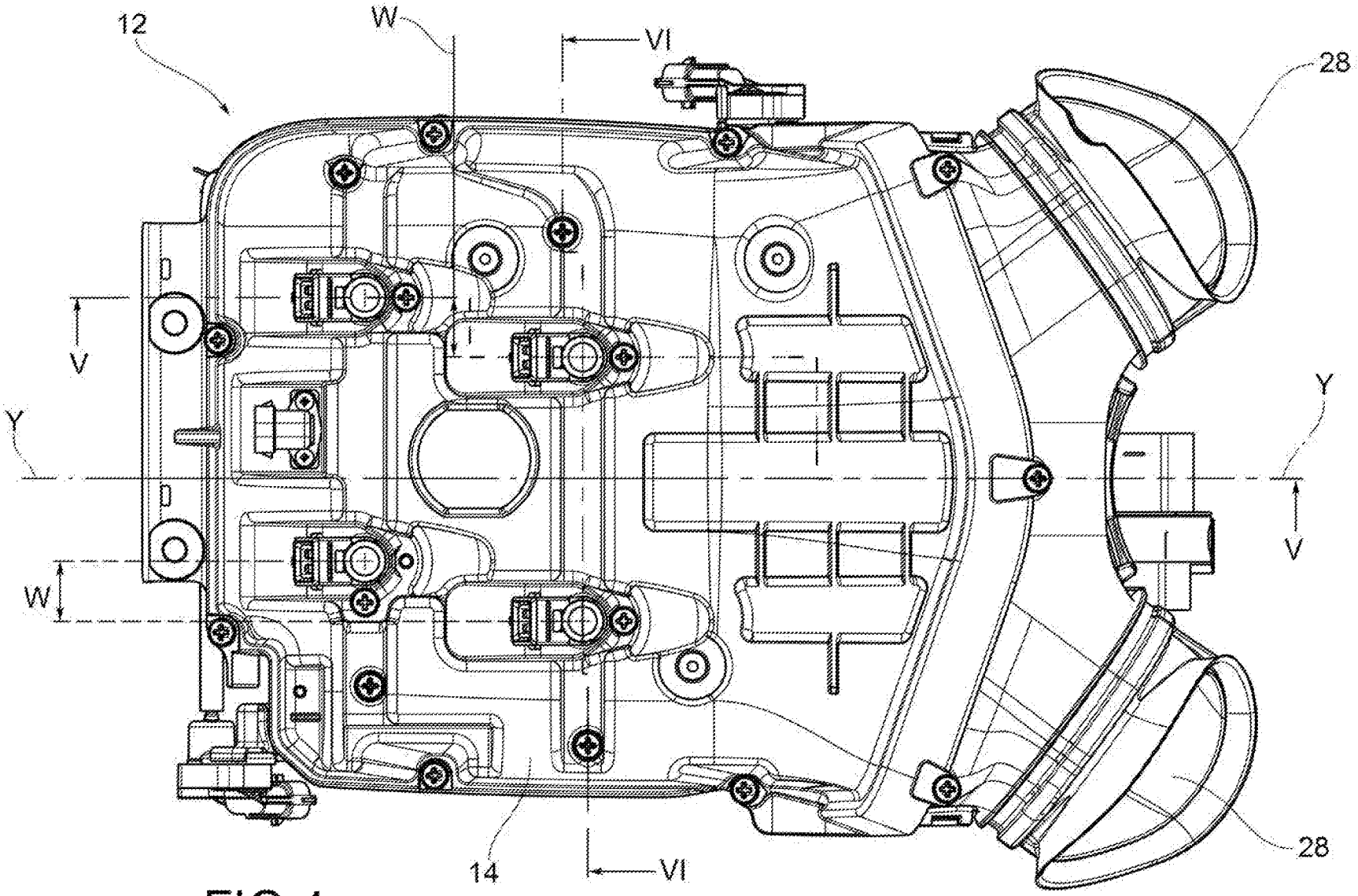
FIG. 4 shows a plan view of the filter box group of the engine in FIG. 1.

Offset W is measured as the distance between the axes of the suction ducts 20, 24, 60, 64 (FIG. 4).

In this way, the overlap between the first front suction duct 20 and the first suction duct 24 with respect to the direction of the suction air/mixture flow is partially reduced.

The present invention is not limited to an engine having only two cylinders, namely to the first pair of cylinders 8.

Figure 3:
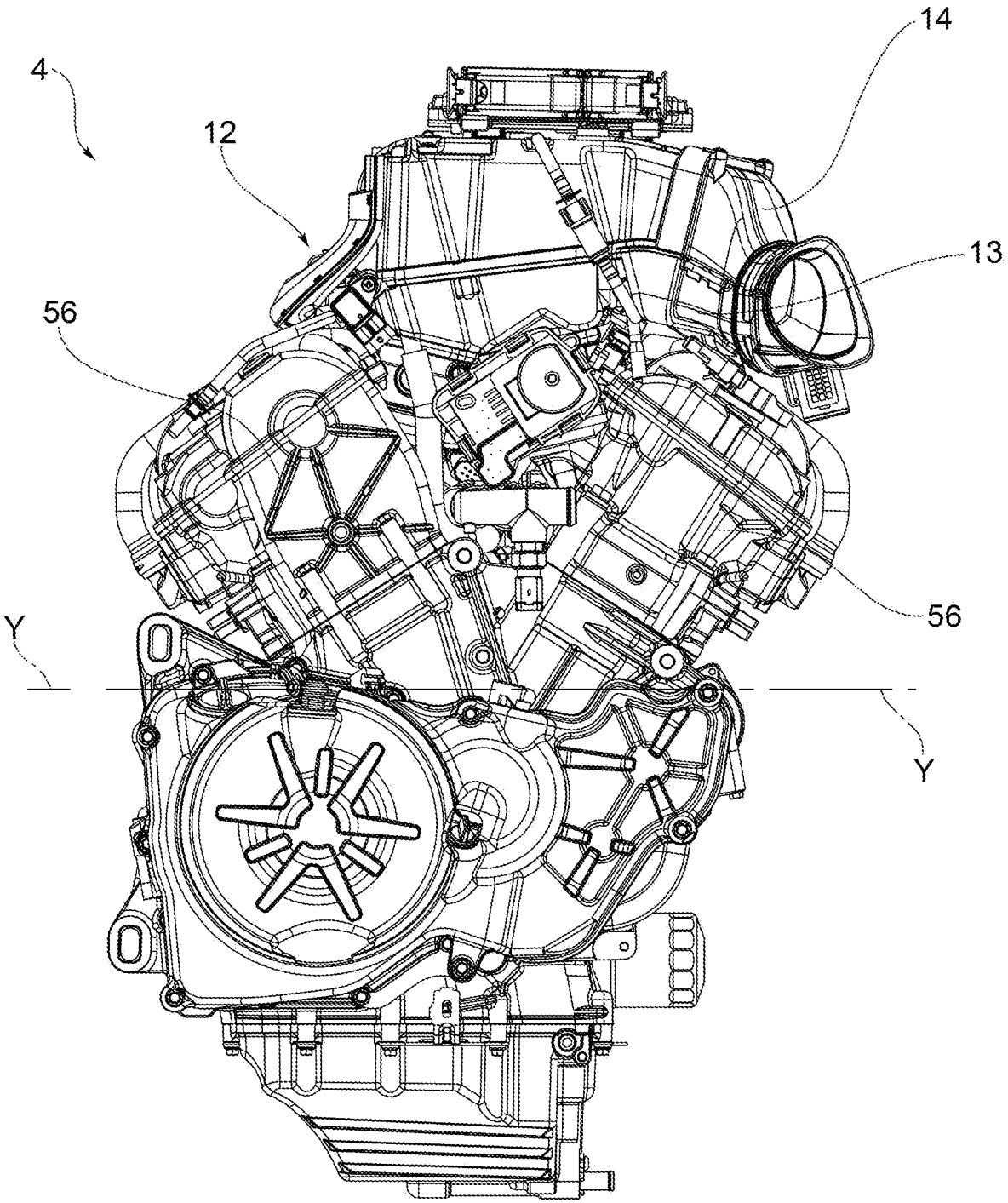
FIG. 3 shows a lateral view of the internal combustion engine in FIG. 1 from the side of arrow III in FIG. 1.

According to a possible embodiment, the internal combustion engine 4 comprises a second pair of cylinders 56 (FIG. 3) which accommodate, according to a rectilinear reciprocating motion, respective second pistons operatively connected to said motor shaft.

The second cylinders 56 are alongside the first cylinder 8 parallel to said motor axis.

The second cylinders 56 are also generally arranged as a 'V', i.e. are not aligned and parallel to each other with respect to a direction parallel to the engine axis X-X, is irrelevant.

In this way, an engine having a total of four cylinders 8, 56 arranged as a 'V' is obtained.

In general, the present invention is applicable to engines with V-shaped arrangement of the cylinders and number ≤2, without any limit.

In the following description, the superscript '2' shall be used to indicate components of the engine relative to the second pair of cylinders 56.

As shown for example in FIG. 8, with regard to the suction system of said second cylinders 56, the suction volume 16 houses at least a second front suction duct 60 and at least a second rear suction duct 64, respectively disposed in an advanced and retracted position in relation to a suction air/mixture inlet direction.

Each second front and rear suction duct 20, 24 channels the suction air/mixture before entering in the respective second cylinders 56.

Advantageously, said second front and rear suction ducts 60, 64 are fixed and have respective mutually different lengths.

Each second front and rear suction duct 60, 64 is divided into two second fixed trumpets at least partially separated and aligned with each other, comprising a second lower trumpet 72 and a second upper trumpet 76, wherein the second upper trumpet 76 is facing an upper injector device 48, the second lower trumpet 72 is facing the corresponding cylinder.

According to one embodiment, with reference to FIG. 7, said second upper and lower trumpets 76, 72 are completely separated from each other, defining a gap G2 between a lower leading edge 80 of the second lower trumpet 72 and an upper trailing edge 84 the second upper trumpet 76.

Gap G2 constitutes a passage section for the suction air/mixture to be channelled within the second cylinders 56.

Gap G2*a* of the second front suction duct 60 is different from gap G2*p* of the second rear suction duct 64, as a function of the inclination and position of the corresponding cylinder.

According to one embodiment, gap G2*a* of the second front suction duct 60 is comprised between 15% and 35% of an inner diameter D2*a* of the second upper trumpet 76 of the second front suction duct 60.

According to one embodiment, gap G2*p* of the second rear suction duct 64 is comprised between 10% and 30% of an inner diameter D2*p* of the second upper trumpet 76 of the second rear suction duct 64.

The internal combustion engine 4 comprises at least one upper fuel injector device 48 oriented so as to inject fuel into each second front and rear suction duct 60, 64, in which an injection point J of each upper fuel injector device 48 is a step P away from an upper leading edge 92 of a corresponding second upper trumpet 76, wherein step P2*a* of the second front suction duct 20 is different from step P2*p* of the second rear suction duct 24.

Preferably, step P2*a* of the second front suction duct 60 is comprised between 3% and 7% of an inner diameter D2*a* of the second upper trumpet 76 of the second front suction duct 60.

According to one embodiment, the injection point J2*a* of the second front suction duct 60 is external with respect to the second upper trumpet 76 of the second front suction duct 60.

In this way, at least partially, the fuel jet injected from the injection point J is subjected to the direct action of the suction air flow that impinges it in a plane parallel to the upper leading edge 92 before the jet enters the second upper trumpet 76.

According to one embodiment, step P2*p* of the second rear suction duct 64 is comprised between 10% and 20% of an inner diameter D2*p* of the second upper trumpet 76 of the second rear suction duct 64.

According to one embodiment, the injection point J2*p* of the second rear suction duct 64 is internal with respect to the second upper trumpet 76 of the second rear suction duct 64.

According to one possible embodiment, wherein gaps G1*a*, G1*p*, G2*a*, G2*p* of the first and second front and rear suction ducts 20, 24, 60, 64 are all different from each other. In this way, each suction duct is tuned to the specific operating conditions of the single cylinder, dictated by the position of the single cylinder with respect to the overall architecture of the engine.

In fact, in an engine with cylinders in a 'V' arrangement, each front or frontal cylinder, with respect to the inlet direction of air/mixture, at least partly hides the corresponding rear cylinder. That means that the rear cylinder receive less air than the front cylinder and that the path that air must travel to reach the rear cylinder is greater than the one it has to travel to reach the front cylinder. In addition, the front and rear cylinders are differently impinged by the flow of outside air and therefore work in different fluid dynamic conditions. These differences then apply, with the same front and rear cylinders, also between the first and second pair of cylinders. In fact, while the cylinders are arranged symmetrically with respect to a centreline plane of he engine/vehicle, they are mutually offset for reasons of space and are arranged in the proximity to various internal members of the engine (for example cylinders arranged on the clutch side and those arranged on the pinion side). This means that, once again, the distances travelled by the supply air/mixture and the fluid dynamic conditions change.

According to one embodiment, said first and second cylinders 8, 56 are partially offset from each other along the transverse direction, by an offset W, so as to have a partial misalignment between them with respect to the suction air/mixture. In this way, the overlap between the first front suction duct 20 and the first suction duct 24, a well as between the second front suction duct 60 and the second rear suction duct 64 with respect to the direction of the suction air/mixture flow is partially reduced.

In order to tune each cylinder to the actual operating conditions, it is possible to suitably vary gaps G and steps P described above.

According to possible embodiment variants, gaps G1*a*, G2*a* of the first and second front suction ducts 24, 64 are equal to each other; it is also possible to provide that gaps G1*p*, G2*p* of the first and second suction ducts 28, 68 are equal to each other.

The same variants may be provided for steps P.

For example, steps P1*a*, P1*p*, P2*a*, P2*p* (FIG. 7) of the first and second front and rear suction ducts 20, 24, 60, 64 are all different from each other.

According to one embodiment, steps P1*a*, P2*a* of the first and second front suction ducts 20, 60 are equal to each other.

According to one embodiment, steps P1*p*, P2*p* of the first and second rear suction ducts 24, 64 are equal to each other.

Moreover, according to one embodiment, step P1*a* of the first front suction duct 20 is opposite step P1*p* of the first rear suction duct 24.

This means that in one case, for example the first front suction duct 20, the injection point J is external with respect to the first upper trumpet 36, and in the other, for example the first rear suction duct 24, the injection point J is internal with respect to the first upper trumpet 36, and vice versa.

The same applies to the second cylinders 56.

Therefore, step P2*a* of the second front suction duct 60 is for example opposite step P2*p* of the second rear suction duct 64.

According to one possible embodiment, the lower leading edge 40*a* of the first and second lower front trumpets 32*a*, 72*a* is positioned below the lower leading edge 40*p* of the first and second lower rear trumpets 32*p*, 72*p*, respectively.

In this way, the first and second lower front trumpets 32*a*, 72*a* do not interfere with the flow of suction air/mixture that must reach the first and second lower rear trumpets 32*p*, 72*p*.

According to one possible embodiment, the upper leading edge 52*a* of the first and second upper front trumpets 36*a*, 76*a* is positioned below the upper leading edge 52*p* of the first and second upper rear trumpets 32*p*, 72*p*, respectively.

According to one possible embodiment, the upper trailing edge 44*a* of the first and second upper front trumpets 36*a*, 76*a* is positioned below the upper trailing edge 44*p* of the first and second upper rear trumpets 36*p*, 76*p*, respectively.

In this way, as seen, the first and second lower front trumpets 32*a*, 72*a* do not interfere with the flow of suction air/mixture that must reach the first and second lower rear trumpets 32*p*, 72*p*.

As seen, the internal combustion engine 4 provides for the presence of upper injector devices 48 which feed the corresponding front 20, 60 and rear 24, 64 suction ducts. Such upper injector devices inject fuel upstream of the corresponding front 20, 60 and rear 24, 64 suction ducts. It is also possible to provide, in addition to and/or in replacement of the upper injector devices 48, the presence of lower injector devices 96 (FIG. 7) which inject fuel downstream of the suction volume 16. Said lower injector devices 96 can inject inside the extension ducts of the lower trumpets or even directly in the combustion chamber.

The use of the upper and lower injector devices can be suitably managed in order to optimise the feeding in all operating conditions of the internal combustion engine.

According to a further possible embodiment of the present invention, the lower cover 13 of the filter box 12 comprises a lower profile 100, shaped so as to direct a flow of suction air/mixture, coming from at least one inlet mouth 28 of the filter box 12, towards said lower leading edge 40 of the first lower trumpet 32.

According to one embodiment, said lower profile 100 forms a support base for an air suction filter 104 housed in said filter box 12.

According to a possible embodiment, said lower profile 100 is a lower profile joined and fixed to the lower cover 13 of the filter box 12.

According to one embodiment, the joined lower profile 100 is movable with respect to a fixing portion thereof to the lower cover 13 of the filter box 12.

For example, the joined lower profile 100 is configured so as to lift, moving away from the lower leading edge 40 and approaching the upper trailing edge 44 as the flow of suction air/mixture decreases, and vice versa. In this way, when the flow of suction air/mixture decreases, as the rotation speed of the engine decreases, said flow is moved away as much as possible from the lower leading edge 40, so that the path followed by the flow of air/mixture increases as a whole. Conversely, when the flow of suction air/mixture increases, as the rotation speed of the engine increases, said flow is approached as much as possible to the lower leading edge 40, so that the path followed by the flow of air/mixture decreases as a whole.

According to one embodiment, the joined lower profile 100 is configured so as to lift up to direct the flow of air outside said gap G1 as the flow of suctioned air/mixture decreases and vice versa. In this way, the increase of the total path that the suctioned flow of air/mixture must travel is promoted even further.

According to a possible embodiment, said joined lower profile 100 is a leaf spring configured so as to bend under the thrust of the suction air coming from the inlet mouth 28 of the filter box 12.

According to a possible embodiment, said joined lower profile 100 is operatively connected to motor means 116 adapted to orient the profile itself as a function of the speed of the flow of suction air/mixture.

According to one embodiment, the upper cover 14 of the filter box 12 comprises an upper profile 108, shaped so as to direct a flow of suction air/mixture, coming from at least one inlet mouth 28 of the filter box 12, towards the upper leading edge 52 of the first upper trumpet 36 (FIG. 5).

Figure 12:
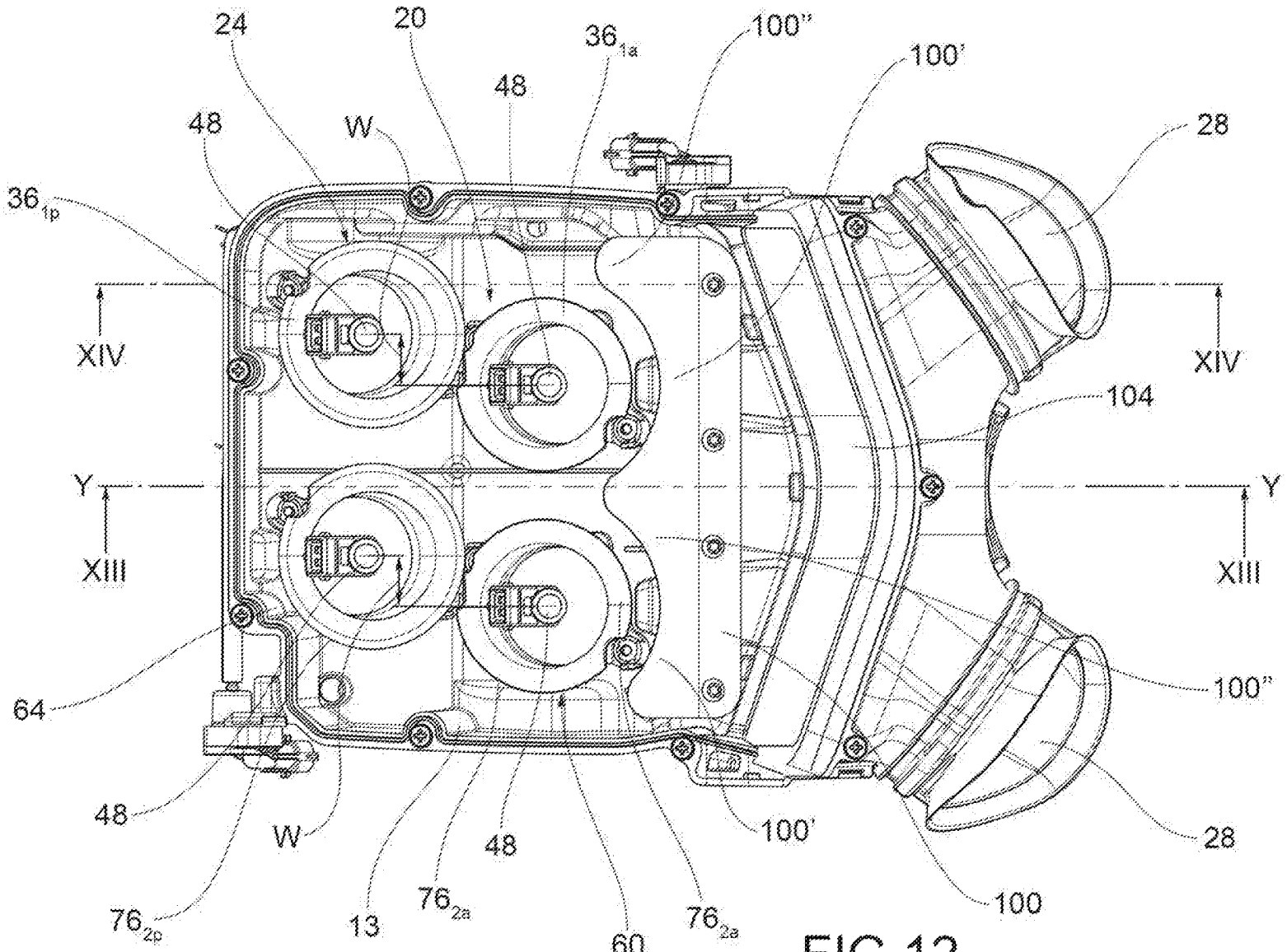
FIG. 12 shows a plan view of a filter box group according to an embodiment of the present invention.
Figure 13:
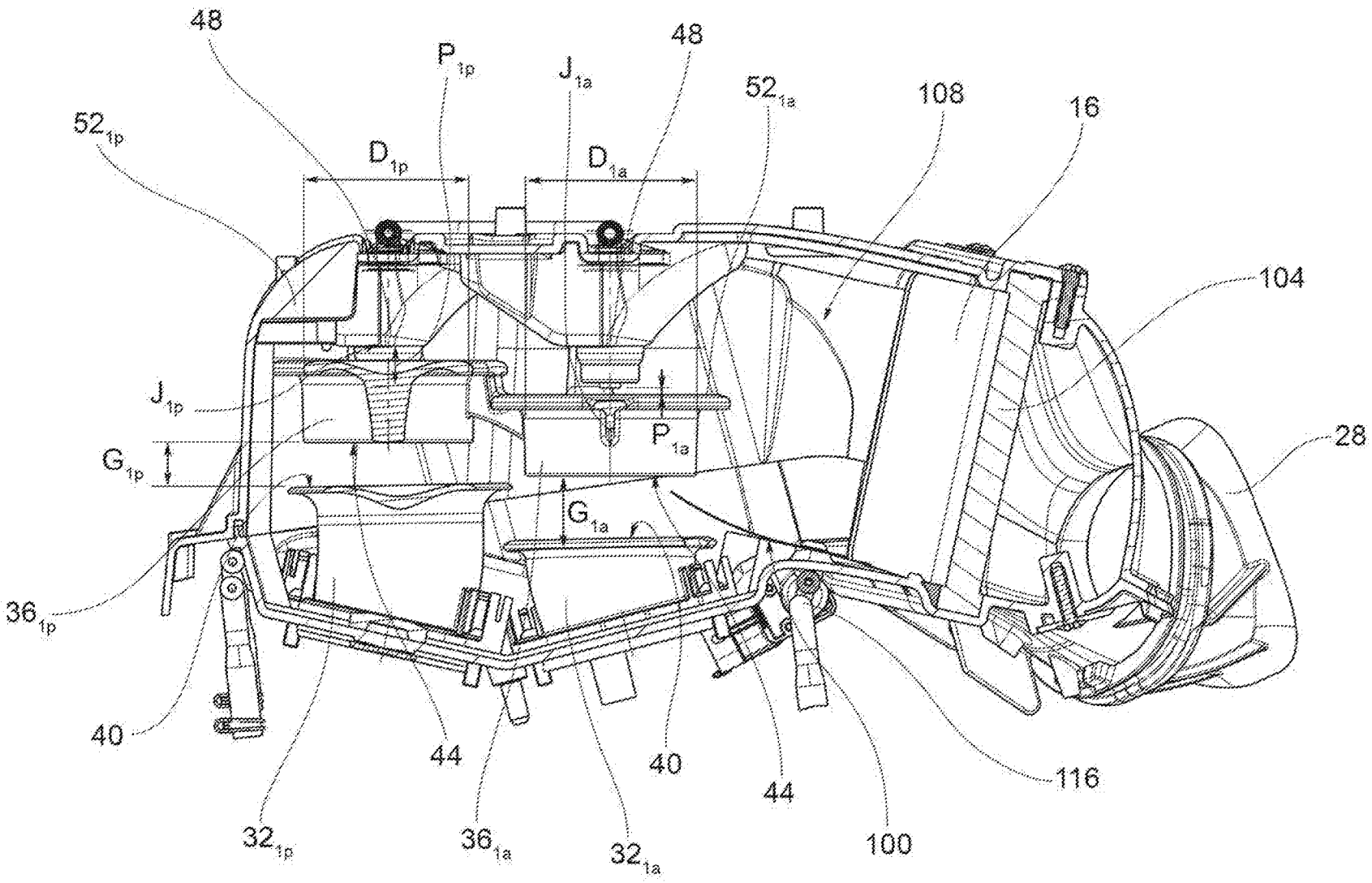
FIG. 13 shows a sectional view of the filter box group in FIG. 12, along the section line XIII-XIII indicated in FIG. 12.
Figures 14, 15:
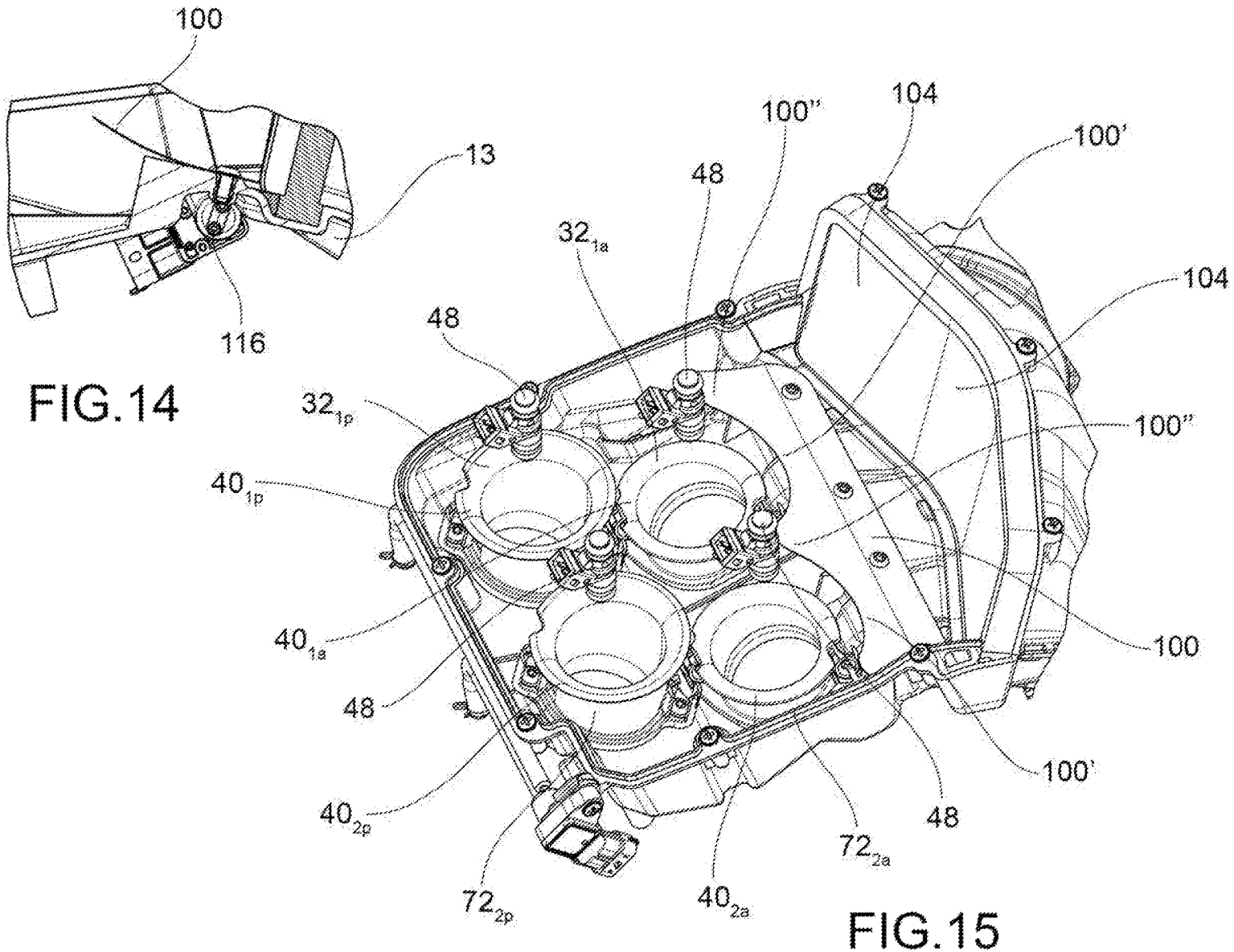
FIG. 14 shows a sectional view of a detail of the filter box group in FIG. 12, along the section line XIV-XIV indicated in FIG. 12.
FIG. 15 shows a partial perspective view of the filter box group in FIG. 12.
Figure 16:
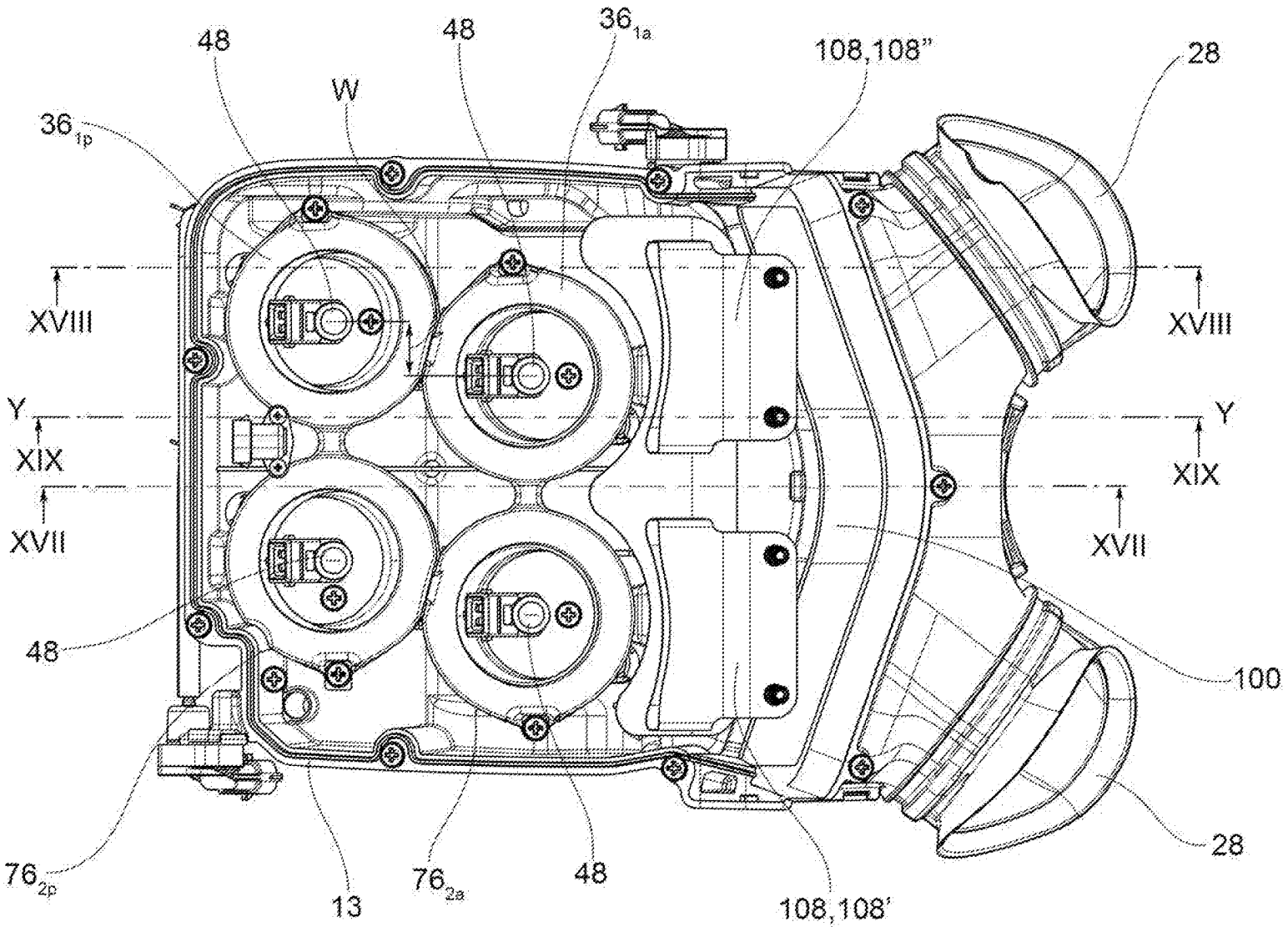
FIG. 16 shows a plan view of a filter box group according to a further embodiment of the present invention.
Figure 17:
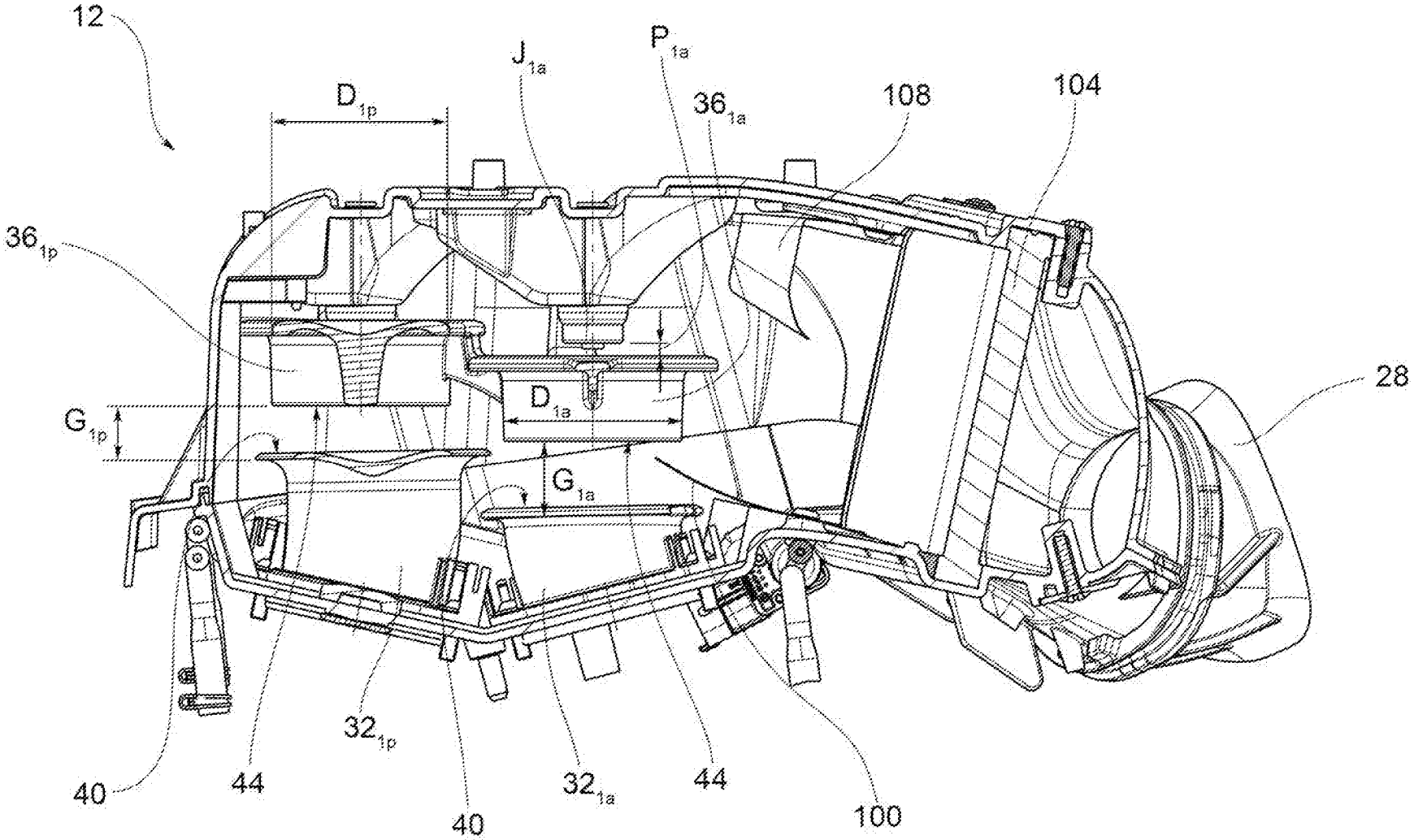
FIG. 17 shows a sectional view of the filter box group in FIG. 16, along the section line XVII-XVII indicated in FIG. 16.
Figure 18:
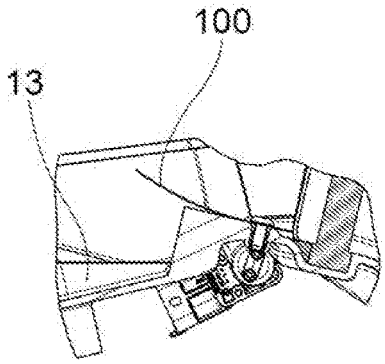
FIG. 18 shows a sectional view of a detail of the filter box group in FIG. 16, along the section line XVIII-XVIII indicated in FIG. 16.
Figure 19:
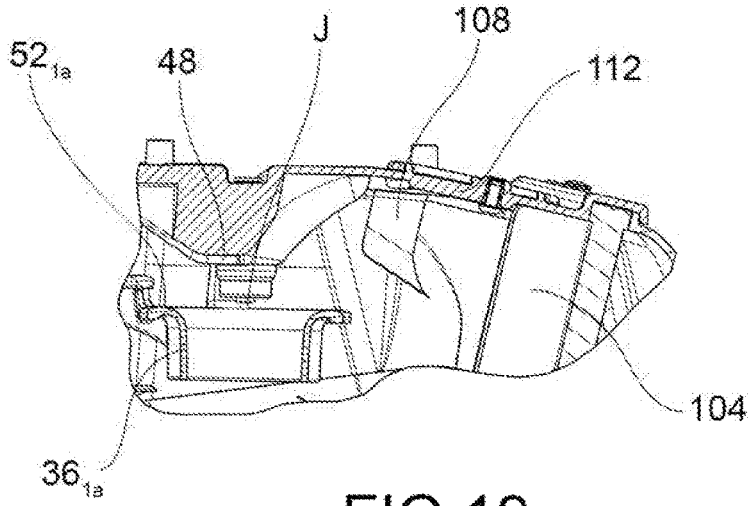
FIG. 19 shows a sectional view of a detail of the filter box group in FIG. 16, along the section line XIX-XIX indicated in FIG. 16.
Figure 20:
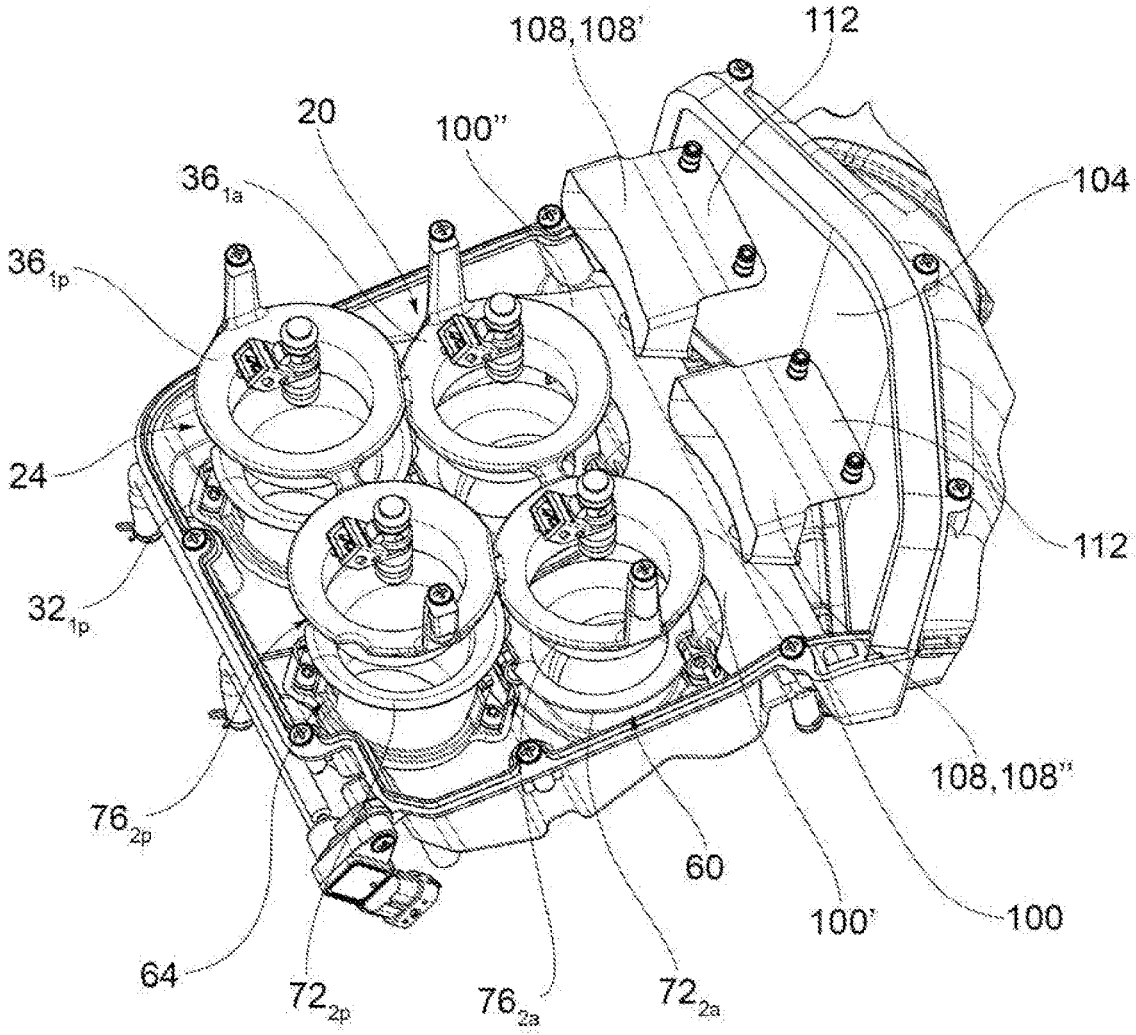
FIG. 20 shows a partial perspective view of the filter box group in FIG. 16.
Figure 21:
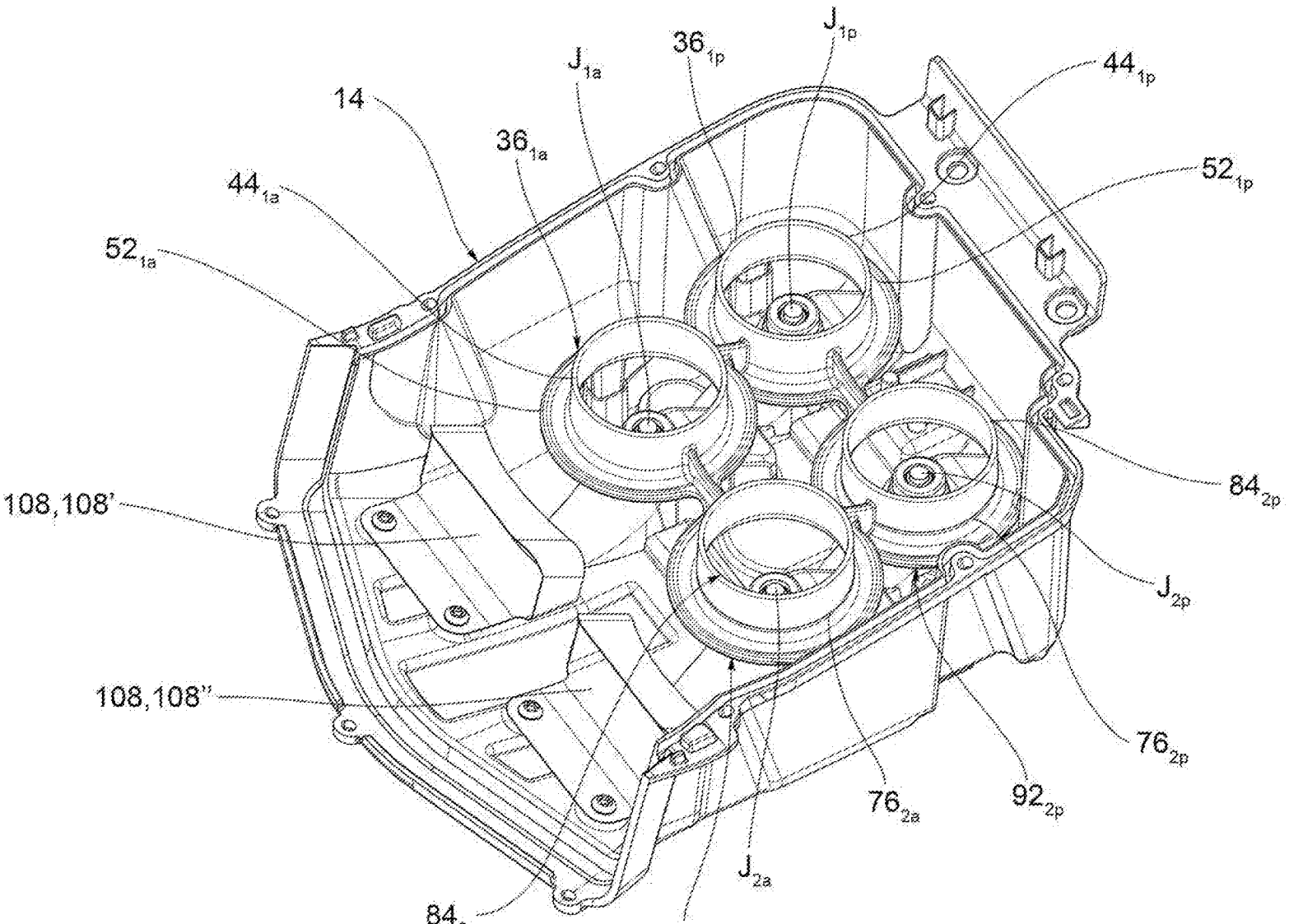
FIGS. 21-22 show perspective views, from different angles, of an upper cover of a filter box for internal combustion engine according to an embodiment of the present invention.
Figure 22:
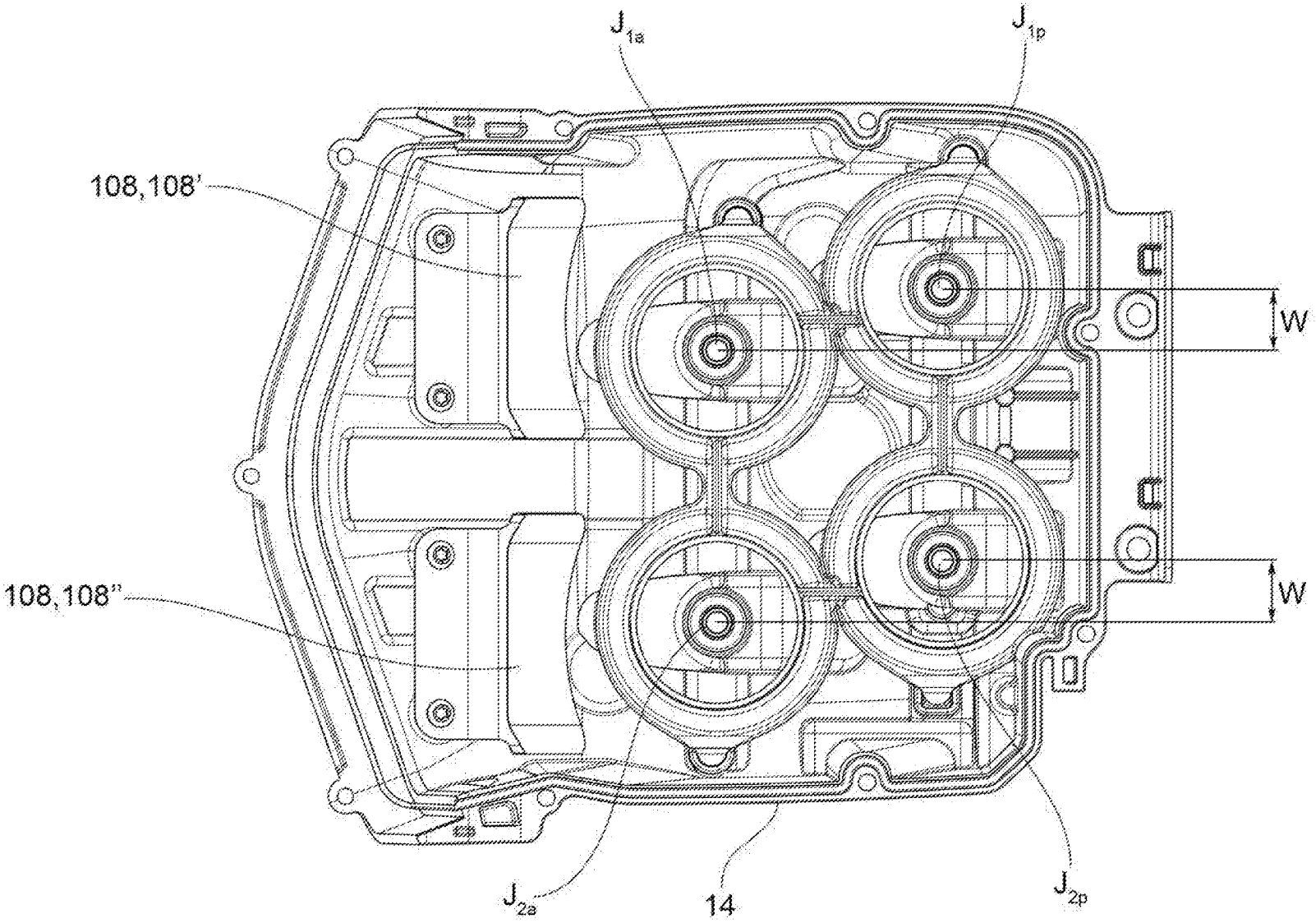
Figure 23:
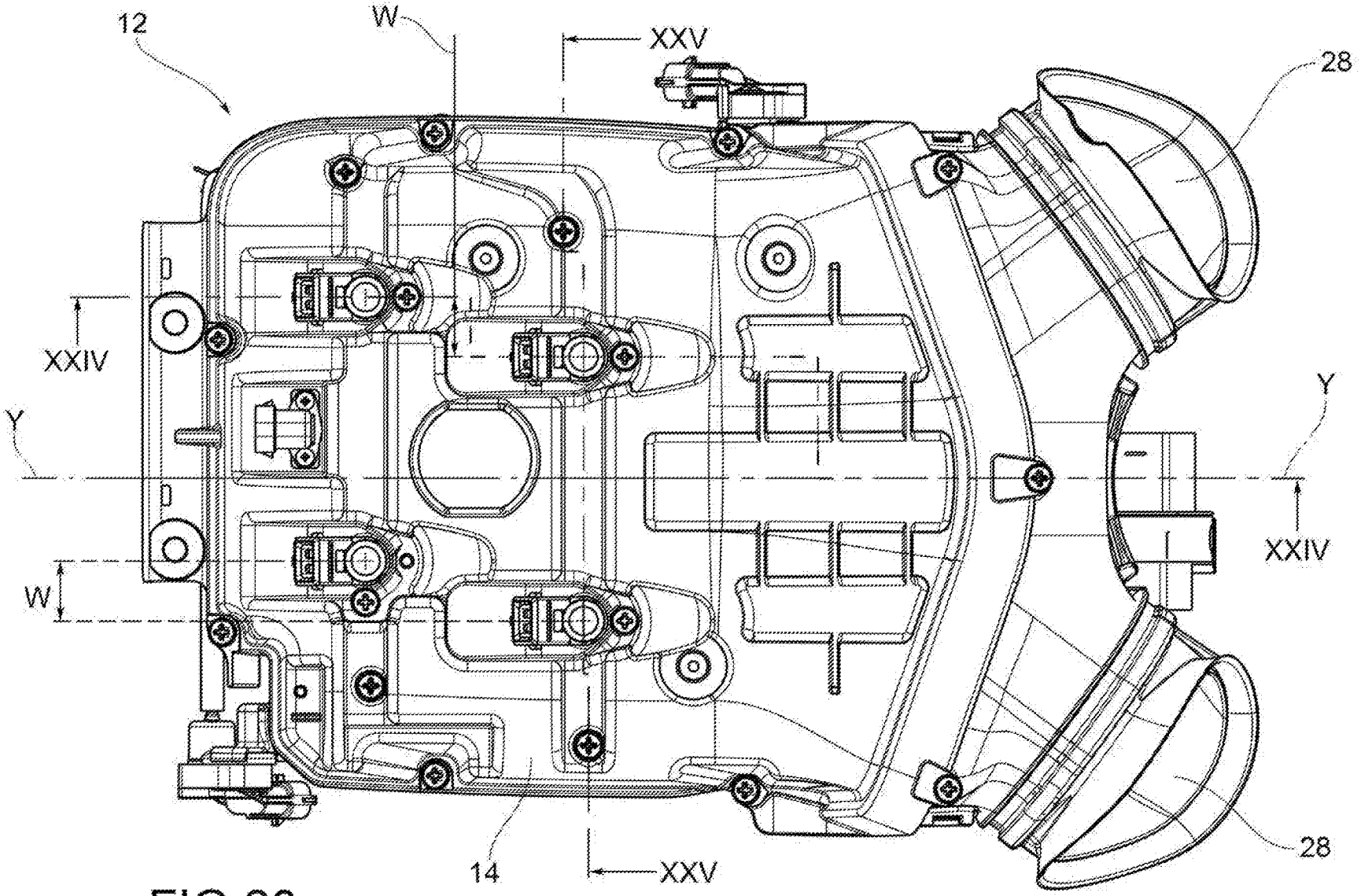
FIG. 23 shows a plan view of a filter box group according to an embodiment of the present invention.
Figure 24:
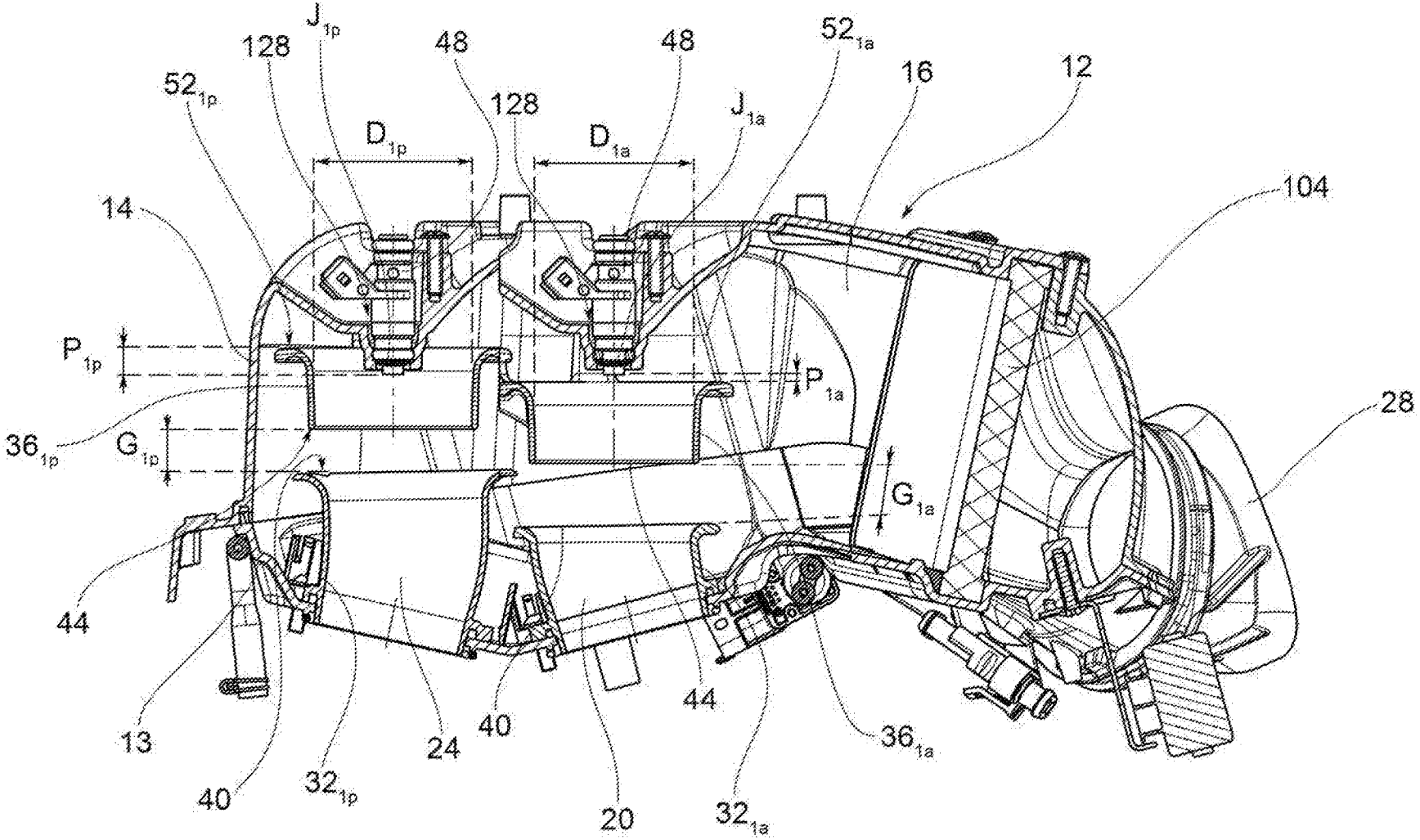
FIG. 24 shows a sectional view of the filter box group in FIG. 23, along the section line XXIV-XXIV indicated in FIG. 23.
Figure 25:
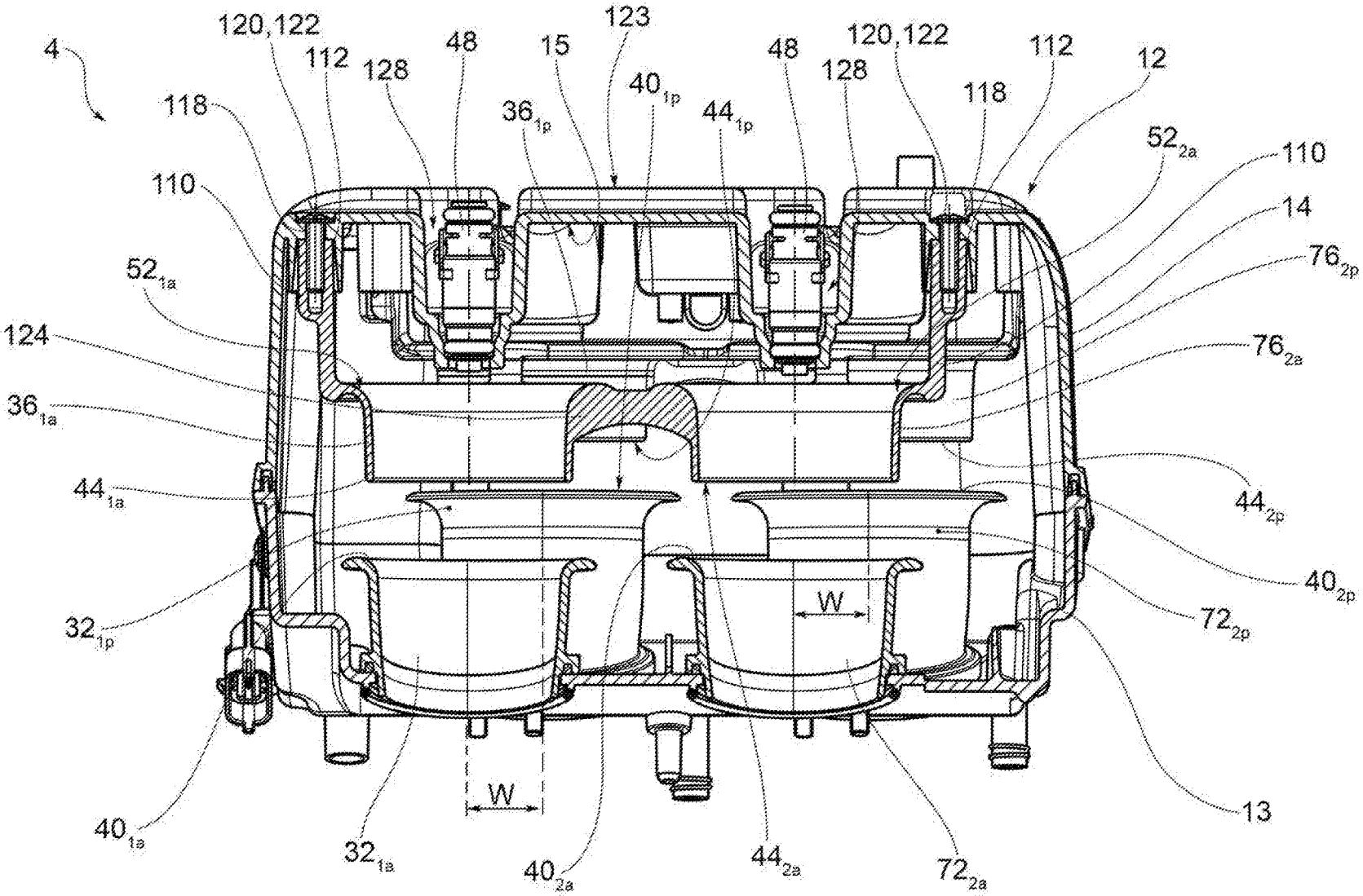
FIG. 25 shows a sectional view of the filter box group of the engine in FIG. 23, along the section line XXV-XXV indicated in FIG. 23.
Figure 26:
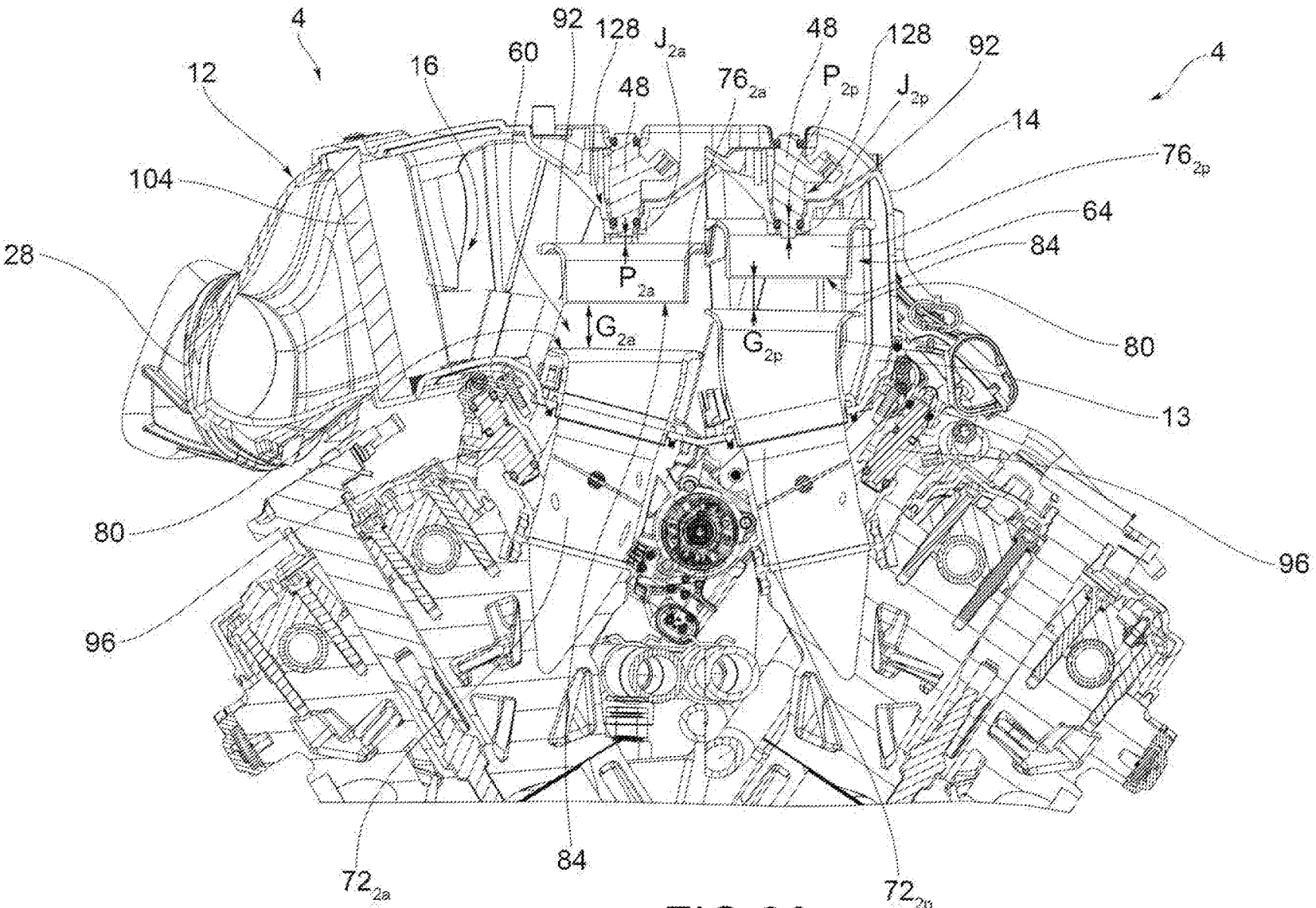
FIG. 26 shows a partially sectional view of a filter box and a part of the head of an internal combustion engine according to the present invention.
Figure 27:
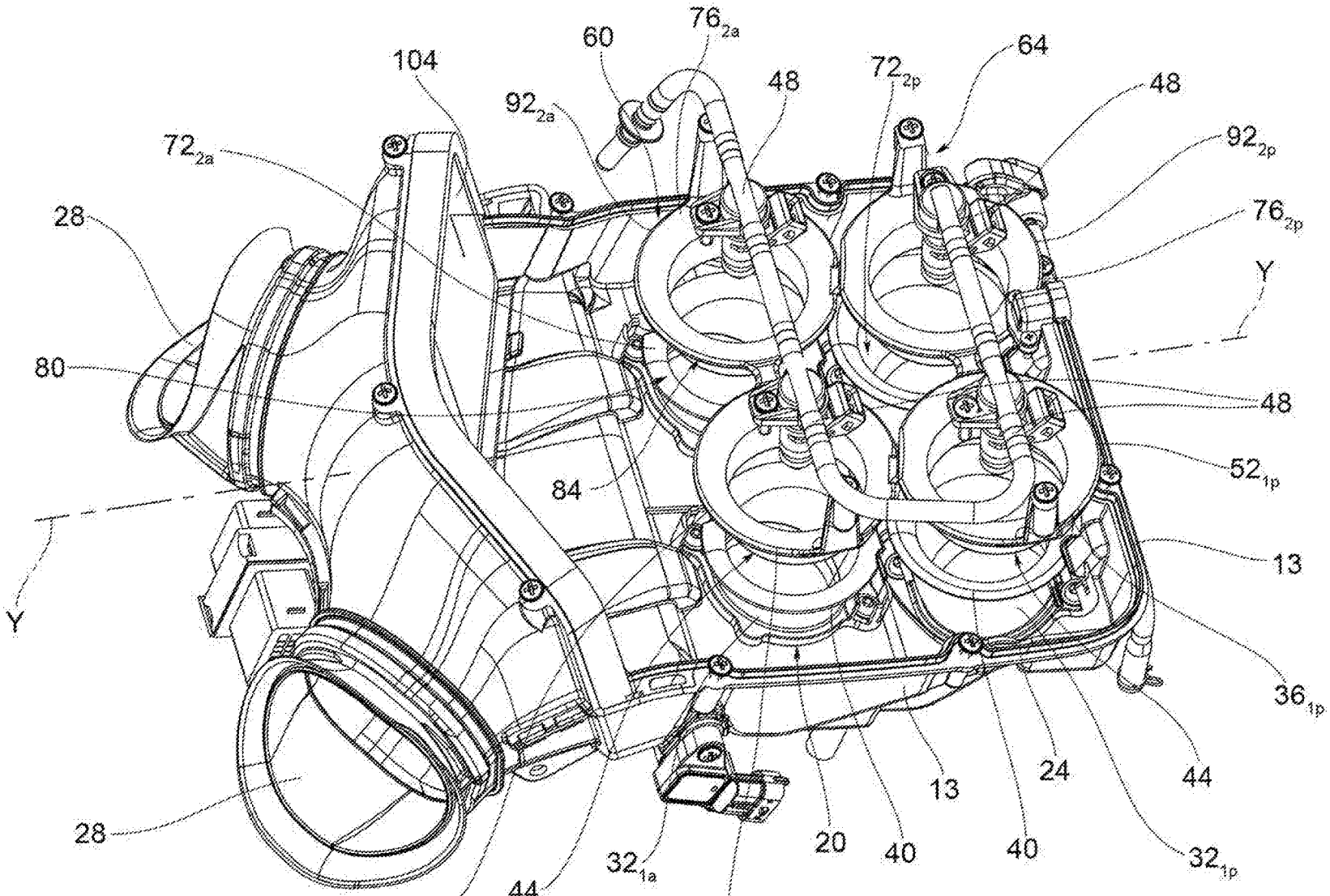
FIG. 27 shows a partial perspective view of a filter box group according to an embodiment of the present invention.
Figure 28:
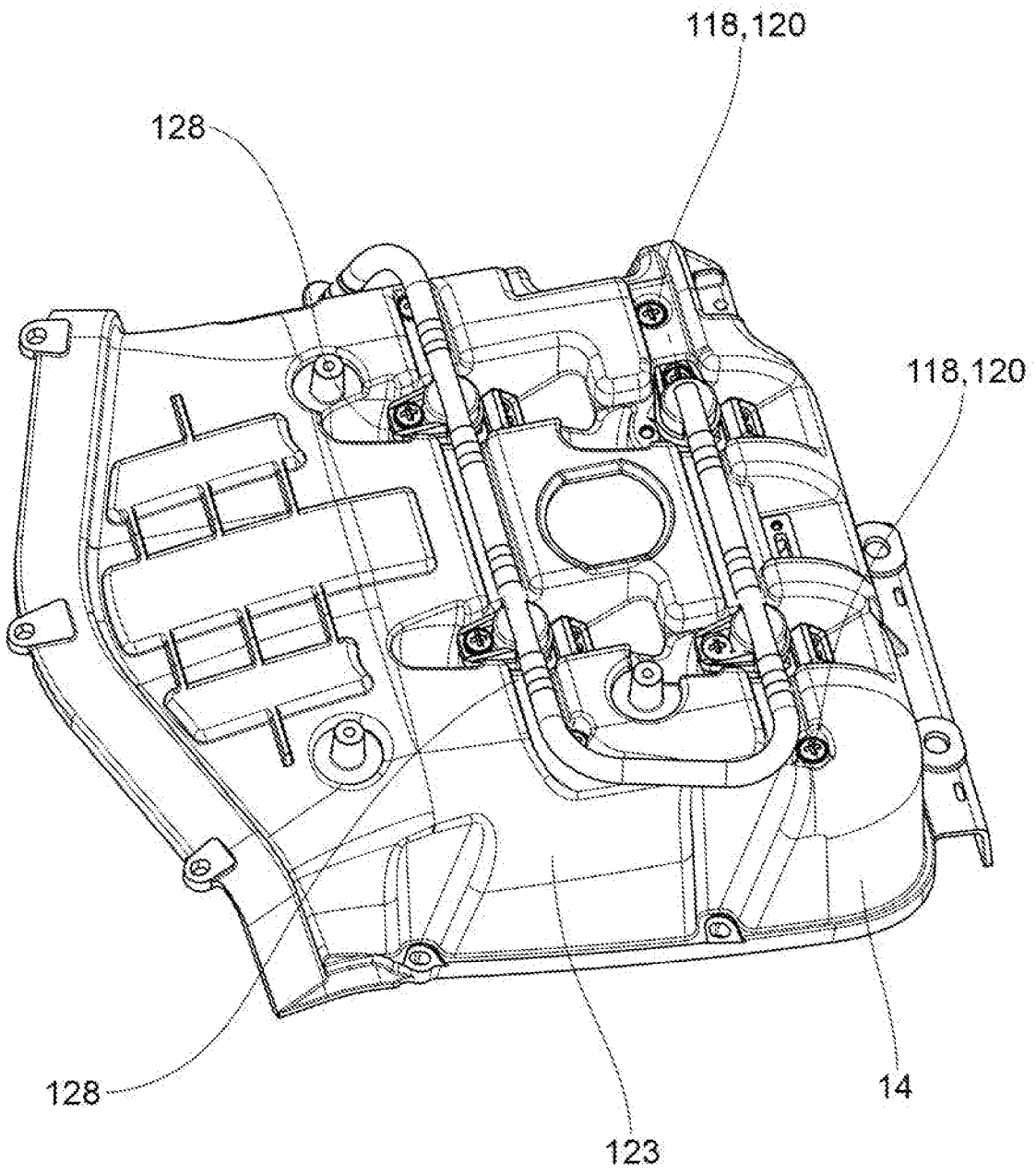
FIGS. 28-29 show perspective views, from different angles, of an upper cover of a filter box for internal combustion engine according to an embodiment of the present invention.
Figure 29:
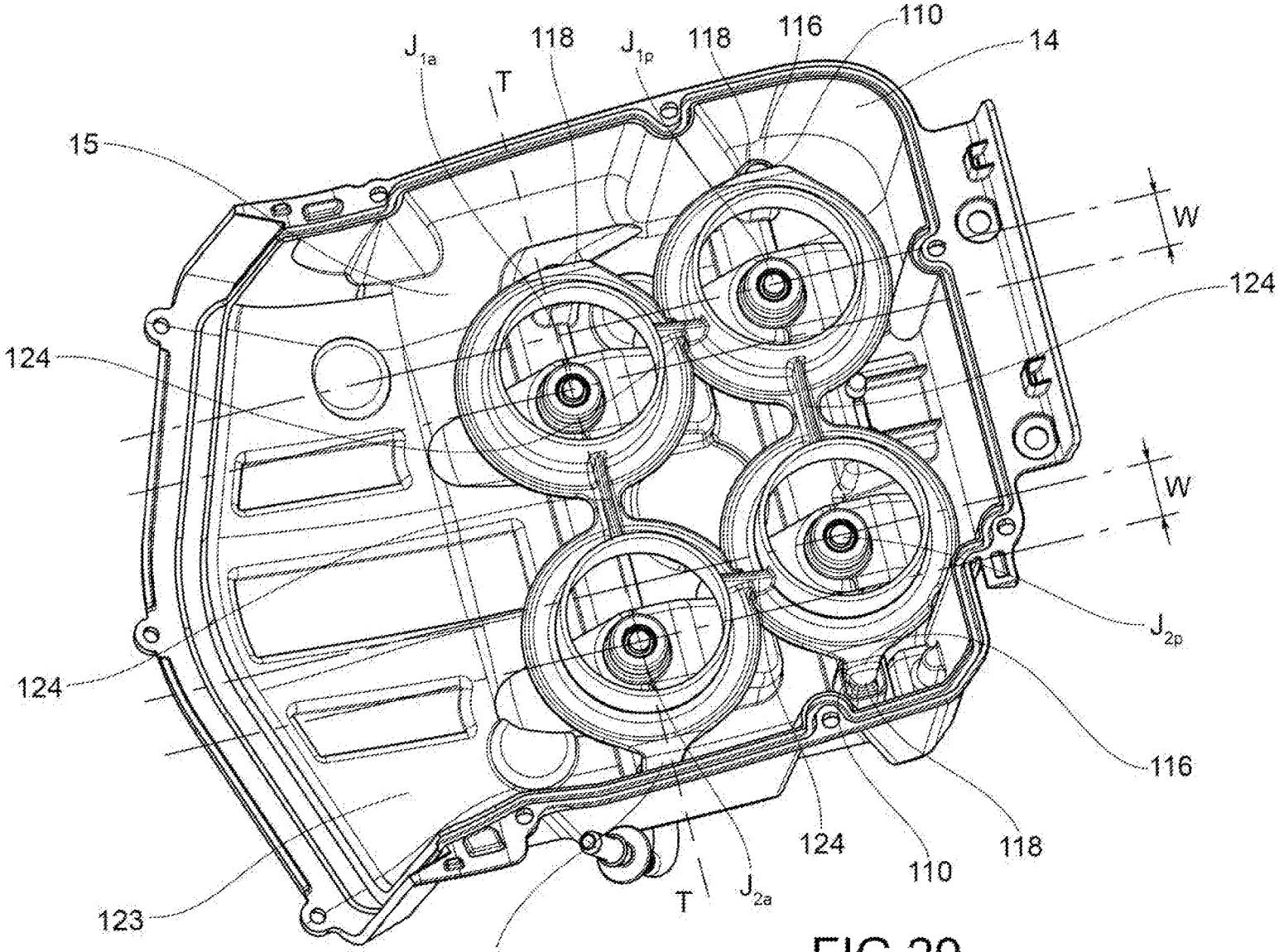

According to one embodiment, the upper profile 108 forms a support abutment 112 (FIG. 12) for the air suction filter 104 housed in said filter box 12.

According to one embodiment, said upper profile 108 is a profile joined and fixed to the upper cover 14 of the filter box 12.

For example, the joined upper profile 108 is movable with respect to the fixing portion thereof to the upper cover 14 of the filter box 12.

According to one embodiment, the joined upper profile 108 is configured so as to lift, approaching the upper leading edge 52, as the flow of suctioned air/mixture decreases and vice versa.

Moreover, the joined upper profile 108 is configured so as to lower up to direct the flow of air towards the lower leading edge 40 as the flow of suctioned air/mixture increases and vice versa.

In this way, when the flow of suction air/mixture decreases, as the rotation speed of the engine decreases, said flow is approached as much as possible to the upper leading edge 52, so that the path followed by the flow of air/mixture increases as a whole. Conversely, when the flow of suction air/mixture increases, as the rotation speed of the engine increases, said flow is moved away from the upper leading edge 52 and approached as much as possible to the lower leading edge 40, so that the path followed by the flow of air/mixture decreases as a whole.

For example, the joined upper profile 108 is a leaf spring configured so as to bend under the thrust of the suction air coming from the inlet mouth 28 of the filter box 12.

According to one embodiment, said joined upper profile 108 is operatively connected to motor means 116 adapted to orient the profile itself as a function of the speed of the flow of suction air/mixture.

Preferably, the engine comprises both the lower profile 100 and the upper profile 108; moreover, said upper and lower profiles 100, 108 operate in synchronism in order to direct the suction air/mixture as a whole towards the upper leading edge 52, for low to medium engine speeds, and direct the flow of suction air/mixture as a whole towards the lower leading edge 40, for high speeds.

This can for example be done by moving the lower profile 100 and the upper profile 108 in synchronism towards the upper leading edge 52, at medium to low engine speeds, and towards the lower leading edge 40, at high engine speeds.

Advantageously, the lower cover 13 of the filter box 12 comprises a lower profile 100, shaped so as to direct a flow of suction air/mixture, coming from at least one inlet mouth 28 of the filter box 12, towards the lower leading edge 40 of the first front suction duct 20 and of the first rear suction duct 24.

For example, the lower profile 100 is shaped so as to direct a flow of suction air/mixture, coming from at least one inlet mouth 28 of the filter box 12, towards the lower leading edge 40 of each lower trumpet 32 associated to each respective cylinder.

According to one embodiment, said first cylinders 8 are partially offset from each other along the transverse direction, by an offset W, and the lower cover 13 comprises two appendages or lower profiles 100',100" mutually offset along he same transverse direction so as to direct portions of flow of suction air/mixture towards said first cylinders 8.

Offset W is measured as the distance between the axes of the suction ducts 20, 24, 60, 64. The lower profiles 100 follow the offset of the cylinders and therefore of the respective trumpets 32 in order to better direct the flow of suction air/mixture towards them.

Likewise, it is provided that the upper cover 14 comprises two appendages or upper profiles 108',108" mutually offset along he same transverse direction so as to direct portions of flow of suction air/mixture towards said first cylinders 8.

According to one embodiment, engine 4 comprises an upper profile 108, as described above, shaped so as to direct a flow of suction air/mixture, coming from at least one inlet mouth 28 of the filter box 12, towards the upper leading edge 52 of each upper trumpet 36, 76 associated to each respective cylinder.

According to one embodiment, the lower cover 13 of the filter box 12 comprises a lower profile 100, shaped so as to direct a flow of suction air/mixture, coming from at least one inlet mouth 28 of the filter box 12, towards the lower leading edge 40 of the first front suction duct 20, of the first rear suction duct 64, of the second front suction duct 60 and of the second rear suction duct 64.

According to one embodiment, engine 4 comprises an upper profile 108, shaped so as to direct a flow of suction air/mixture, coming from at least one inlet mouth 28 of the filter box 12, towards the upper leading edge 92 of each upper trumpet 36, 76 associated to each respective cylinder.

According to one embodiment, said first and second cylinders 8 are partially offset from each other along the transverse direction, and the upper cover 14 comprises two appendages or lower profiles 100',100" mutually offset along he same transverse direction so as to direct portions of flow of suction air/mixture towards said first and second cylinders 8, 56.

In other words, the lower profiles 100 follow the offset of the cylinders and therefore of the respective trumpets 32 in order to better direct the flow of suction air/mixture towards them. Likewise, it is provided that the upper cover 14 comprises two appendages or upper profiles 108',108" mutually offset along he same transverse direction so as to direct portions of flow of suction air/mixture towards said first cylinders 8,56.

According to one embodiment, said second upper and lower trumpets 76, 72 are completely separated from each other, defining a gap G2 between a lower leading edge 80 of the second lower trumpet 72 and an upper trailing edge 84 the second upper trumpet 76.

According to a possible embodiment, the internal combustion engine 4 comprises:

at least one first cylinder 8 accommodating, according to a rectilinear reciprocating motion, a relative first piston operatively connected to a moor shaft rotating about an engine axis X-X, a suction system comprising a filter box 12 having a lower cover 13 and an upper cover 14 defining a suction volume 16 housing at least one first suction duct 20 for conveying suction air/mixture to said first cylinder, the first suction duct 20 being divided into a first lower trumpet 32 and a first upper trumpet 36, separated from each other so as to define a gap G1 between the upper trailing edge 44 of the first upper trumpet 36 and a lower leading edge 40 of the first lower trumpet, the first upper trumpet 36, at an upper leading edge 52 thereof, being facing an upper injector device 48, the first lower trumpet 32 being facing the corresponding cylinder and being fixed to the lower cover 13 of the filter box 12, wherein the lower cover 13 of the filter box 12 comprises a lower profile 100, shaped so as to direct a flow of suction air/mixture, coming from at least one inlet mouth 28 of the filter box 12, towards said lower leading edge 40 of the first lower trumpet 32.

According to a further embodiment of the present invention, the internal combustion engine 4 comprise:

at least one first cylinder 8 accommodating, according to a rectilinear reciprocating motion, a relative first piston operatively connected to a moor shaft rotating about an engine axis X-X, a suction system comprising a filter box 12 having a lower cover 13 and an upper cover 14 defining a suction volume 16 housing at least one first suction duct 20 for conveying suction air/mixture to said first cylinder, the first suction duct 20 being divided into a first lower trumpet 32 and a first upper trumpet 36, separated from each other so as to define a gap G1 between the upper trailing edge 44 of the first upper trumpet 36 and a lower leading edge 40 of the first lower trumpet, the first upper trumpet 36, at an upper leading edge 52 thereof, being facing an upper injector device 48, the first lower trumpet 32 being facing the corresponding cylinder and being fixed to the lower cover 13 of the filter box 12, wherein the upper cover 14 of the filter box 12 comprises an upper profile 108, shaped so as to direct a flow of suction air/mixture, coming from at least one inlet mouth 28 of the filter box 12, towards said upper leading edge 52 of the first upper trumpet 36.

According to a further embodiment of the present invention, the internal combustion engine 4 comprise:

at least one cylinder 8 accommodating, according to a rectilinear reciprocating motion, a relative first piston operatively connected to a moor shaft rotating about an engine axis X-X, a suction system comprising a filter box 12 comprising a lower cover 13 and an upper cover 14 associated to each other, which define a suction volume 16 housing at least one first suction duct 20 which channels the suction air/mixture before entering the respective cylinder, wherein said first suction duct comprises two first fixed trumpets at least partially separated and aligned with each other, comprising a first lower trumpet 32 and a first upper trumpet 36, the first upper trumpet 36 being facing an upper injector device 48, the first lower trumpet 32 being facing the corresponding cylinder, wherein the first upper trumpet 36 is associated with the upper cover (14) by fixing means 118 arranged between the first upper trumpet 36 and an inner side wall 15 of the upper cover 14.

Advantageously, the first upper trumpet 36 is associated with the upper cover 14 by fixing means 118 arranged between the first upper trumpet 36 and an inner side wall 15 of the upper cover 14.

According to an embodiment, said fixing means 118 comprise at least one leg 110 integral with the first upper trumpet 36 and provided with a fixing abutment 112 on the upper cover 14.

Preferably, said at least one leg 110 is arranged on a side end 116 of the first upper trumpet 36, with respect to a transverse direction T, perpendicular to a suction and feeding direction of the air/mixture inside the suction volume 16.

According to further embodiments, said fixing means 118 comprise adhesives.

According to a further embodiment, said fixing means 118 comprise a welding. For example, an ultrasonic welding may be made, making the leg of a welding-compatible material with respect to the material of the upper cover 14.

According to a further embodiment, said fixing means 118 comprise snap-wise shape couplings.

According to a further embodiment, the fixing fixing means 118 comprise threaded connection means 120 inserted from the outside of the filter box 12, through holes 122 made on an upper wall 123 of the upper cover 14. This prevents the risk that the threaded fixing means 120 may accidentally disconnect and fall into the suction ducts.

It should be noted that all the embodiments of the fixing means 118 described above are not necessarily alternative to each other but may coexist with each other.

The operation of an internal combustion engine for motor vehicles according to the present invention shall now be described.

As already mentioned, the present invention aims to 'tune' the pressure waves of each cylinder so as to obtain the maximum degree of filling of each cylinder without the aid of oversizing and/or movable parts, such as variable-length suction ducts.

Due to the architecture and the relative arrangement between the front and rear trumpets of the various cylinders, it is possible to create flows of suction air/mixture that do not interfere with each other so as to achieve an optimum filling of each cylinder over a wide rotative speed of the engine.

As can be appreciated from the description, the present invention allows overcoming the drawbacks of the prior art.

In fact, the present invention allows optimising the volumetric filling of the internal combustion engine, over a wide range of engine speeds, without movable parts, drives and motors.

This reduces costs, dimensions and weights of the suction apparatus (and of the respective internal combustion engine) without sacrificing an increased performance of the engine itself.

The suction system according to the invention allows optimising the volumetric efficiency of the internal combustion engine in a extremely wide operating range, similar to that obtained using more complex, cumbersome and expensive solutions with movable parts, comprising turbocharging systems and/or variable geometry ducts.

In addition, the partitions provided, whether in the form of a profile built into the filter box, or in the form of joined profile, are able to convey the flow of suction air/mixture in the respective suction trumpets, following the architecture of the internal combustion engine, that is, the relative arrangement of the cylinders.

Also, as seen, it is possible to vary the suction path of the flow of air/mixture as a function of the rotation speed of the engine. In particular, at low to medium engine speeds, it is preferable that the path is elongated, while at higher speeds it is preferable that the path is shorter.

Moreover, making a cover of a filter box which supports and connects also the upper trumpets allows reducing the number of components within the suction volume, so as to simplify the assembly and maintenance operations.

For example, the operator by removing the upper cover is able to remove in one operation the trumpets themselves so as to have quick access to the lower trumpets and to the cylinders.

Preferably, the upper cover also supports the injectors so that the removal thereof allows, in the same operation, also the removal of the injectors themselves.

Moreover, the fixing of the upper trumpets to the upper cover allows eliminating fixing brackets and bridges with the lower cover, which are used in the prior art solutions for the same purpose. Such brackets and bridges in fact reduce the useful suction volume with equal overall dimensions of the filter box.

Moreover, such brackets and bridges worsen the fluid dynamics of the suction flow inside the suction volume, creating turbulence and obstacles which reduce the filling coefficient and thus the performance obtainable from the engine.

A man skilled in the art may make several changes and adjustments to the engines and suction systems described above in order to meet specific and incidental needs, all falling within the scope of protection defined in the following claims.

The invention claimed is:

1. Internal combustion engine comprising:

a first pair of cylinders housing, according to a reciprocating rectilinear motion, relative first pistons operatively connected to a drive shaft rotating about a motor axis, an intake system comprising a filter box which defines an intake volume which houses at least a first front intake pipe and at least a first rear intake pipe respectively placed forward and rearward in relation to an input direction of an intake/airflow mixture, each intake pipe channelling the intake air/mixture before entering the respective cylinders, wherein said first front and rear intake pipes are fixed, wherein each first front and rear intake pipe is divided into two first trumpets fixed and completely separated and aligned with each other, comprising a first lower trumpet and a first upper trumpet, the first upper trumpet facing an upper injector device, the first lower trumpet facing the corresponding cylinder, said first upper and lower trumpets identifying a gap between a lower input edge of the first lower trumpet and an upper output edge of the first upper trumpet, the gap of the first front intake pipe being different from the gap of the first rear intake pipe.

2. Internal combustion engine according to claim 1, wherein the gap of the first front intake pipe is different from the gap of the first rear intake pipe depending on the inclination of the corresponding cylinder, wherein the gap of the first front intake pipe is between 15% and 35% of an inner diameter of the first upper trumpet of the first front intake pipe, the gap of the first rear intake pipe is between 10% and 30% of an inner diameter of the first upper trumpet of the first rear intake pipe.

3. Internal combustion engine according to claim 1, wherein the internal combustion engine comprises at least one upper fuel injector device oriented so as to inject fuel into each first front and rear intake pipe wherein an injection point of each upper fuel injector device is one step from an upper input edge of a corresponding first upper trumpet, wherein the step of the first front intake pipe is different from the step of the first rear intake pipe, where the step of the first front intake pipe is between 3% and 7% of an inner diameter of the first upper trumpet of the first front intake pipe.

4. Internal combustion engine according to claim 1, wherein the injection point of the first front intake pipe is external to the first upper trumpet of the first front intake pipe.

5. Internal combustion engine according to claim 3, where the step of the first rear intake pipe is between 10% and 20% of an inner diameter of the first upper trumpet of the first rear intake pipe.

6. Internal combustion engine according to claim 3, wherein the injection point of the first rear intake pipe is internal to the first upper trumpet of the first rear intake pipe.

7. Internal combustion engine according to claim 1, wherein the internal combustion engine comprises a second pair of cylinders housing, according to a reciprocating rectilinear motion, relative second pistons operatively connected to said drive shaft, the second cylinders being juxtaposed to the first cylinders parallel to said motor axis, the intake volume housing at least a second front intake pipe and at least a second rear intake pipe respectively placed forward and backward in relation to an input direction of the intake air/mixture, each second intake pipe channelling the intake air/mixture before entering the respective cylinders, wherein said second front and rear intake pipes are fixed and have respective different lengths from each other.

8. Internal combustion engine according to claim 7 wherein each second front and rear intake pipe is divided into two second trumpets fixed and at least partially separate and aligned with each other, comprising a second lower trumpet and a second upper trumpet, the second upper trumpet facing an upper injector device, the second lower trumpet facing the corresponding cylinder.

9. Internal combustion engine according to claim 8, wherein said second upper and lower trumpets are completely separate from each other, identifying a gap between a lower input edge of the second lower trumpet and an upper output edge of the second upper trumpet, the gap of the second front intake pipe being different from the gap of the second rear intake pipe depending on the inclination and position of the corresponding cylinder, wherein the gap of the second front intake pipe is between 15% and 35% of an inner diameter of the second upper trumpet of the second front intake pipe, wherein the gap of the second rear intake pipe is between 10% and 30% of an inner diameter of the second upper trumpet of the second rear intake pipe.

10. Internal combustion engine according to claim 9, wherein the internal combustion engine comprises at least one upper fuel injector device oriented so as to inject fuel into each second front and rear intake pipe wherein an injection point of each upper fuel injector device is one step from an upper input edge of a corresponding second upper trumpet, wherein the step of the second front intake pipe is different from the step of the second rear intake pipe, wherein the step of the second front intake pipe is between 3% and 7% of an inner diameter of the second upper trumpet of the second front intake pipe, wherein the injection point of the second front intake pipe is external to the second upper trumpet of the second front intake pipe, wherein the step of the second rear intake pipe is between 10% and 20% of an inner diameter of the second upper trumpet of the second rear intake pipe, the injection point of the second rear intake pipe is internal to the second upper trumpet of the second rear intake pipe.

11. Internal combustion engine according to claim 2, wherein the gaps of the first and second front and rear intake pipes are all different from each other or the gaps of the first and second front intake pipes are the same as each other.

12. Internal combustion engine according to claim 9, wherein the gaps of the first and second rear intake pipes are the same as each other.

13. Internal combustion engine according to claim 1, wherein:

the steps of the first and second front and rear intake pipes are all different from each other, or the steps of the first and second front intake pipes are the same as each other, or the steps of the first and second rear intake pipes are the same as each other.

14. Internal combustion engine according to claim 3, wherein the step of the first front intake pipe is opposite the step of the first rear intake pipe, or the step of the second front intake pipe is opposite the step of the second rear intake pipe.

15. Internal combustion engine according to claim 8, wherein a lower input edge of the first and second lower front trumpets is positioned below a lower input edge of the first and second rear lower trumpets respectively, wherein an upper input edge of the first and second upper front trumpets is positioned below an upper input edge of the first and second rear upper trumpets respectively, wherein an upper output edge of the first and second upper front trumpets is positioned below an upper output edge of the first and second rear upper trumpets respectively.

16. Internal combustion engine comprising:

at least a first cylinder housing, according to a reciprocating rectilinear motion, a relative first piston operatively connected to a drive shaft rotating about an engine axis, an intake system comprising a filter box having a bottom cover and a top cover defining an intake volume which houses at least a first intake pipe for conveying an intake/airflow mixture, to said first cylinder, the first intake pipe being divided into a first lower trumpet and a first upper trumpet, separated from each other in order to identify a gap between an upper output edge of the first upper trumpet and a lower input edge of the first lower trumpet, the first upper trumpet, at its upper input edge, facing an upper injector device, the first lower trumpet facing the corresponding cylinder and being fastened to the bottom cover of the filter box, wherein the bottom cover of the filter box comprises a lower profile, contoured to direct a intake airflow/mixture, coming from at least one input mouth of the filter box, towards said lower input edge of the first lower trumpet.

17. Internal combustion engine according to claim 16, wherein said lower profile realizes a support base for an air intake filter housed in said filter box, wherein said lower profile is:

mobile with respect to an attachment portion thereof to the bottom cover of the filter box; or configured to rise, moving away from the lower input edge and moving towards the upper output edge, upon the decrease of the intake airflow/mixture and vice versa; or is configured to rise until it directs the airflow outside said gap upon the decrease of the intake airflow/mixture and vice versa; or a leaf spring configured to bend under the thrust of the intake air coming from the input mouth of the filter box, or operatively connected to motor means suitable to direct the profile depending on the intake airflow/mixture regimen.

18. Internal combustion engine comprising:

at least a first cylinder housing, according to a reciprocating rectilinear motion, a relative first piston operatively connected to a drive shaft rotating about an engine axis, an intake system comprising a filter box having a bottom cover and a top cover defining an intake volume which houses at least a first intake pipe for conveying an intake/airflow mixture, to said first cylinder, the first intake pipe being divided into a first lower trumpet and a first upper trumpet, separated from each other in order to identify a gap between an upper output edge of the first upper trumpet and a lower input edge of the first lower trumpet, the first upper trumpet, at its upper input edge, facing an upper injector device, the first lower trumpet facing the corresponding cylinder and being fastened to the bottom cover of the filter box, wherein the top cover of the filter box comprises an upper profile, contoured to direct the intake/airflow mixture, coming from at least one input mouth of the filter box, towards said upper input edge of the first upper trumpet, said upper profile realizes a support abutment for an air intake filter housed in said filter box, more said upper profile is selected from:

a fitted profile attached to the top cover of the filter box;

a mobile profile with respect to its attachment portion to the top cover of the filter box;

a profile configured to rise, approaching the upper input edge, upon the decrease of the intake airflow/mixture and vice versa;

a profile configured to lower itself to direct the airflow towards the upper input edge, upon the increase of the intake airflow/mixture and vice versa;

said upper fitted profile is a leaf spring configured to bend under the thrust of the intake air coming from the input mouth of the filter box;

said upper fitted profile is operatively connected to motor means suitable to direct the profile depending on the intake airflow/mixture regimen.

19. Internal combustion engine comprising:

at least one cylinder housing, according to a reciprocating rectilinear motion, a relative first piston operatively connected to a drive shaft rotating about an engine axis, an intake system comprising a filter box comprising a bottom cover and a top cover joined to each other defining an intake volume which houses at least a first intake pipe which channels an intake/airflow mixture, before entering the respective cylinder, wherein said first intake pipe comprises two first trumpets fixed and at least partially separate and aligned with each other, comprising a first lower trumpet and a first upper trumpet, the first upper trumpet facing an upper injector device, the first lower trumpet facing the corresponding cylinder, wherein the first upper trumpet is joined to the top cover by attachment means placed between the first upper trumpet and an inner side wall of the top cover.

20. Internal combustion engine according to claim 19, wherein said attachment means comprise at least one foot integral with the first upper trumpet and provided with an attachment ledge on the top cover, said attachment means are selected from:

glues;

a weld;

shaped snap-fastening;

threaded connection means inserted from the outside of the filter box through holes made on an upper wall of the top cover, wherein said at least one foot is placed on a side end of the first upper trumpet, with respect to a transverse direction, perpendicular to an intake and advancement direction of the air/mixture inside the intake volume.

* * * * *